US005747227A

United States Patent [19]

Kawai

[11] Patent Number: 5,747,227

[45] Date of Patent: May 5, 1998

[54] METHOD OF FORMING COLORED IMAGES

[75] Inventor: Kiyoshi Kawai, Kanagawa, Japan

[73] Assignee: Fuji Photo Film Co., Ltd., Kanagawa, Japan

[21] Appl. No.: 305,298

[22] Filed: Sep. 15, 1994

Related U.S. Application Data

[63] Continuation of Ser. No. 53,199, Apr. 28, 1993, abandoned.

[30] Foreign Application Priority Data

Apr. 28, 1992 [JP] Japan ..... 4-134520

[51] Int. Cl.[6] ..... G03C 7/407

[52] U.S. Cl. ..... 430/363; 430/388; 430/389; 430/558

[58] Field of Search ..... 430/363, 388, 430/389, 558

[56] References Cited

U.S. PATENT DOCUMENTS

| | | | |
|---|---|---|---|
| 4,619,892 | 10/1986 | Simpson et al. | 430/505 |
| 5,057,405 | 10/1991 | Shiba et al. | 430/363 |
| 5,213,958 | 5/1993 | Motoki et al. | 430/558 |

FOREIGN PATENT DOCUMENTS

| | | |
|---|---|---|
| A-1558452 | 2/1969 | France . |
| A-4015645 | 1/1992 | Japan . |
| 1204680 | 11/1967 | United Kingdom . |

*Primary Examiner*—Hoa Van Le
*Attorney, Agent, or Firm*—Sughrue, Mion, Zinn, Macpeak & Seas, PLLC

[57] ABSTRACT

A method of forming colored images is disclosed. A silver halide color photographic photosensitive material which contains at least one yellow coupler represented by formula (I) in a yellow color forming silver halide emulsion layer which is established on a support is exposed using a scanning exposure system in which the exposure time per picture element is shorter than $10^{-4}$ seconds and then subjected to color development processing:

(I)

wherein A represents

X represents an organic group which is required to form, along with the nitrogen atom, a nitrogen containing heterocyclic ring, Y represents an aromatic group or a heterocyclic group, and Z represents a group which is eliminated on reaction of the coupler represented by formula (I) with an oxidation product of a developing agent.

The method provides high quality hard copy both cheaply and quickly by means of a scanning exposure using high density light such as lasers for example. It also provides a method of forming colored images which is improved in respect of the variation in photographic performance with respect to fluctuations in development processing.

22 Claims, No Drawings

METHOD OF FORMING COLORED IMAGES

This is a continuation of application Ser. No. 08/053,199, filed Apr. 28, 1993, now abandoned.

FIELD OF THE INVENTION

This invention relates to silver halide photographic photosensitive materials and a method of forming colored images therewith to quickly obtain high quality colored images by means of a scanning exposure using high density light such as a laser.

BACKGROUND OF THE INVENTION

There has been rapid development in recent years of techniques in which picture information is converted to electrical signals and, if desired, transmitted and stored and reproduced on a CRT. The demand for hard copy from such picture information has increased with these developments and various hard copy techniques have been suggested. However, with many of these techniques the picture quality is low and with color hard copy in particular the results do not compare well to prints obtained using existing color papers. Pictorography (trade name) from the Fuji Film Co. in which a silver halide thermal development dye diffusion system and an LED scanning exposure system are employed is one example of a system for providing hard copy of high picture quality.

On the other hand, as a result of the progress which has been made with silver halide photosensitive materials and simple compact rapid development systems (for example the mini-lab system), high quality photographic prints can be provided cheaply and comparatively easily in a short period of time. There is a great demand for high image quality hard copy materials for picture information which are similarly cheap, with which processing can be achieved easily and quickly, and which provide a stable level of performance.

In general, scanning exposure systems in which the exposure is made while emitting the picture information sequentially are used to obtain hard copy from electrical signals and a photosensitive material which is suitable for this purposes is required. In order to shorten the scanning exposure time it is necessary to use a light source which has a high output and to make the exposure time for each picture element as short as possible. Progress has been made with the modulation control of scanning exposure light sources in recent years and they can now be controlled to short times of $10^{-7}$ seconds or less per picture element. However, when silver halide emulsion grains are exposed to high levels of illumination for short periods of time the development activity of the latent image which is formed by the exposure is low and the rate of development is slow and, moreover, it is known that there are large variations in photographic performance due to fluctuations in the developer. Moreover, the use of silver halide emulsions which have a high silver chloride content as disclosed in International Patent WO87/04534 is necessary if the development processing operation is to be carried out easily and quickly. However, when a silver halide emulsion which has a high silver chloride content is used, the variation in photographic performance due to fluctuations in the processing baths on short term exposure to high levels of illumination is inevitably even greater than that with silver bromide emulsions or silver chlorobromide emulsions which have a low silver chloride content. Moreover, if the development processing operation time is reduced the variation in photographic performance due to fluctuations in the processing baths also becomes greater.

Hence, a technique in which a latent image formed by subjecting a high silver chloride silver halide emulsion to a short exposure at a high brightness level is developed in as short a time as possible and in a stable manner is needed to provide hard copy easily and quickly and with a fixed level of performance.

Conventionally, light sources such as glow lamps, xenon lamps, mercury lamps, tungsten lamps and light emitting diodes have been employed as exposing light sources in scanning exposure type recording apparatus. However, these light sources all have a weak output and they have a further practical disadvantage in that they have short lifetimes. Scanners are now available in which coherent laser light sources such as gas lasers, for example He-Ne lasers, argon lasers and He-Cd lasers, and semiconductor lasers are used in order to make up for these disadvantages.

Gas lasers provide a high output but they have disadvantages in that the apparatus is large and expensive, and in that a modulator is required.

On the other hand, semiconductor lasers are small and cheap, they can be modulated easily, and they also have the advantage of having a longer life time than gas lasers for example. The emission wavelength of these semiconductor lasers is, in the main, in the range from red into the infrared. Two methods of use can be considered when using these semiconductor lasers as light sources. First there is the method in which a semiconductor laser is combined with a non-linear optical element and the visible second harmonic is separated out and used to expose a silver halide photographic photosensitive material which has been spectrally sensitized to visible light. Secondly there is the method in which semiconductors which emit light ranging from red to infrared are used to expose a silver halide photographic photosensitive material which is highly photosensitive to the red/infrared region.

However, when compared with blue/green spectrally sensitized photosensitive materials, the conventional red/infrared photosensitive materials provide unstable latent images, and the variations in photographic performance due to fluctuations in development processing are considerable. Moreover, with the short high intensity exposures for which high density light such as lasers are used the variations due to processing are even greater and the system cannot be used in practice.

The use of benzoyl type or pivaloyl type yellow couplers in which the ortho-position of the acetanilide is substituted with an alkoxy group for example has been disclosed in JP-A-4-15645 with a view to controlling photographic variations in the yellow color forming photosensitive layer due to fluctuations in the processing baths. (The term "JP-A" as used herein signifies an "unexamined published Japanese patent application".) However, even when these couplers are used the effect is inadequate, and further improvement is required.

SUMMARY OF THE INVENTION

Hence, an object of the present invention is to provide a color photographic photosensitive material and a method of forming an image therewith which can provide high quality hard copy cheaply and quickly, and in which the variability in photographic performance in respect to fluctuations in development processing is improved.

The above mentioned object of the invention has been achieved by a method of forming a colored image using a silver halide color photographic photosensitive material comprising a support, having thereon at least three silver halide photosensitive layers which have different color sensitivities and which contain yellow, magenta, and cyan color forming couplers, respectively, wherein at least one yellow dye forming coupler represented by formula (I) is included in at least one yellow color forming coupler containing photosensitive layer of the silver halide color photographic photosensitive material, and the photosensitive material is exposed using a scanning exposure system in which the exposure time per picture element is less than $10^{-4}$ seconds and subsequently subjected to color development processing:

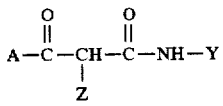

(I)

wherein:

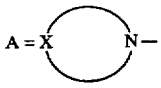

In formula (I), X represents an organic group which is required, together with the nitrogen atom, to form a nitrogen containing heterocyclic ring, Y represents an aromatic group or a heterocyclic group, and Z represents a group which is eliminated when a coupler represented by formula (I) reacts with an oxidation product of a developing agent.

Furthermore, the object of the invention can be realized more effectively by including silver halide grains having a silver chloride content of at least 95 mol % in at least one yellow color forming coupler containing photosensitive layer.

Moreover, the object of the invention can be realized more effectively with a method of forming a colored image wherein the spectral sensitivity peak of the silver halide photosensitive layer containing the yellow dye forming coupler represented by formula (I) is above 430 nm and a laser is used as the scanning exposure light source, or with a method of forming a colored image wherein the spectral sensitivity peaks of the three silver halide photosensitive layers which have different color sensitivities are all above 560 nm and a semiconductor laser is used as the scanning exposure light source. That is to say, the use of a semiconductor laser or SHG (second harmonic generating) light obtained by combining a non-linear optical crystal with a semiconductor laser or a solid laser is most desirable for making exposures quickly. At the present time, SHG light above 430 nm can be used. Furthermore, the wavelength range of semiconductor lasers in use at the present time or under development is roughly above 560 nm, and it is necessary to use photosensitive materials which have a spectral sensitivity in this wavelength region. However, the variation in photographic performance due to processing bath fluctuations generally becomes greater as the wavelength becomes longer. Hence, with a construction of the present invention it is possible to use practical semiconductor lasers as a result of the use of photosensitive layers which have a peak spectral sensitivity above 430 nm, and preferably over 560 nm, and the variation in photographic performance due to processing bath fluctuations is greatly improved and so it is possible to obtain stable hard copy quickly.

Moreover, the objects of the invention can be realized more effectively by exposing with a scanning exposure system in which the exposure time per picture element is less than $10^{-7}$ second.

Furthermore, in the aforementioned methods of forming a colored image, the color development processing time is preferably not more than 25 seconds and the total processing time from the color development process to the completion of drying is preferably not more than 120 seconds.

DETAILED DESCRIPTION OF THE INVENTION

The couplers represented by formula (I) are described in detail below.

The nitrogen containing heterocyclic ring represented by A may be a saturated or unsaturated, single ring or condensed ring, substituted or unsubstituted ring which has at least 1 carbon atom, preferably from 1 to 20 carbon atoms, and most desirably from 2 to 12 carbon atoms. Oxygen, sulfur or phosphorus atoms may be included in these rings as well as nitrogen atoms. The ring may contain one or more of each of these hetero atoms. The ring is an at least three membered ring, preferably a three to twelve membered ring, and most desirably a five or six membered ring.

Actual examples of heterocyclic groups represented by A include pyrrolidino, piperidino, morpholino, 1-imidazolidinyl, 1-pyrazolyl, 1-piperazinyl, 1-indolinyl, 1,2,3,4-tetrahydroquinoxalin-1-yl, 1-pyrrolinyl, pyrazolidin-1-yl, 2,3-dihydro-1-indazolyl, isoindolin-2-yl, 1-indolyl, 1-pyrrolyl, benzothiazin-4-yl, 4-thiazin-yl benzodiazin-1-yl, aziridin-1-yl, benzoxazin-4-yl, 2,3,4,5-tetrahydroquinolyl and phenoxazin-10-yl.

When Y in formula (I) represents an aromatic group it is a substituted or unsubstituted aromatic group which has at least 6, and preferably from 6 to 10, carbon atoms.

When Y in formula (I) represents a heterocyclic group it is a saturated or unsaturated, substituted or unsubstituted heterocyclic group which has at least 1, preferably from 1 to 10, and most desirably from 2 to 5, carbon atoms. Nitrogen, sulfur or oxygen atoms are preferred as hetero atoms. The ring is preferably a five or six membered ring, but it may be of some other size. It may be a single ring or a condensed ring. Actual examples when Y represents a heterocyclic group include 2-pyridyl, 4-pyrimidinyl, 5-pyrazolyl, 8-quinolyl, 2-furyl and 2-pyrrolyl.

In those cases where the group represented by A and the group represented by Y in formula (I) have substituent groups, these may be, for example, halogen atoms (for example, fluorine, chlorine), alkoxycarbonyl groups (which have from 2 to 30, and preferably from 2 to 20, carbon atoms, for example methoxycarbonyl, dodecyloxycarbonyl, hexadecyloxycarbonyl), acylamino groups (which have from 2 to 30, and preferably from 2 to 20, carbon atoms, for example acetamido, tetradecanamido, 2-(2,4-di-tert-amylphenoxy)butanamido, benzamido), sulfonamido groups (which have from 1 to 30, and preferably from 1 to 20, carbon atoms, for example methanesulfonamido, dodecanesulfonamido, hexadecanesulfonamido, benzenesulfonamido), carbamoyl groups (which have from 2 to 30, and preferably from 2 to 20, carbon atoms, for example N-butylcarbamoyl, N,N-diethyl-carbamoyl), sulfamoyl groups (which have from 1 to 30, and preferably from 1 to 20 carbon atoms, for example N-butylsulfamoyl, N-dodecylsulfamoyl, N-hexadecylsulfamoyl, N-3-(2,4-di-tert-amylphenoxy)butylsulfamoyl), alkoxy groups (which have from 1 to 30, and preferably from 1 to 20, carbon atoms, for example methoxy, dodecyloxy), N-acylsulfamoyl groups (which have from 2 to 30, and preferably from 2 to 20, carbon atoms, for example N-propanoylsulfamoyl, N-tetradecanoylsulfamoyl), sulfonyl groups (which have from 1 to 30, and preferably from 1 to 20, carbon atoms, for example methanesulfonyl, octanesulfonyl, dodecanesulfonyl), alkoxycarbonylamino groups (which have from 1 to 30, and preferably from 1 to 20, carbon atoms, for example methoxycarbonylamino, tetradecyloxycarbonylamino), cyano groups, nitro groups, carboxyl groups, aryloxy groups (which have from 6 to 20, and preferably from 6 to 10, carbon atoms, for example phenoxy, 4-chlorophenoxy), alkylthio groups (which have from 1 to 30, and preferably from 1 to 20, carbon atoms, for example methylthio, dodecylthio), ureido groups (which have from 1 to 30, and preferably from 1 to 20, carbon atoms, for example, phenylureido), aryl groups (including substituted and unsubstituted aromatic groups having at least 6, and preferably from 6 to 10, carbon atoms), heterocyclic groups (including the heterocyclic groups described as Y when Y is a hetero-cyclic group), sulfo groups, alkyl groups (linear chain, branched or cyclic, saturated or unsaturated, substituted or unsubstituted alkyl groups which have from 1 to 30, and preferably from 1 to 20, carbon atoms, for example methyl, ethyl, isopropyl, cyclopropyl, trifluoromethyl, cyclopentyl, dodecyl, 2-hexyloctyl), acyl groups (which have from 1 to 30, and preferably from 2 to 20, carbon atoms, for example acetyl, benzoyl), arylthio groups (which have from 6 to 20, and preferably from 6 to 10, carbon atoms, for example phenylthio), sulfamoylamino groups (which have from 0 to 30, and preferably from 0 to 20, carbon atoms, for example N-butylsulfamoylamino, N-dodecylsulfamoylamino), N-acylcarbamoyl groups (which have from 2 to 30, and preferably from 2 to 20, carbon atoms, for example N-dodecanoylcarbamoyl), N-sulfonylcarbamoyl groups (which have from 1 to 30, and preferably from 2 to 20, carbon atoms, for example N-hexadecanesulfonylcarbamoyl, N-benzenesulfonylcarbamoyl, N-(2-octyloxy-5-tert-octylbenzenesulfonyl)carbamoyl), N-sulfamoylcarbamoyl groups (which have from 1 to 30, and preferably from 1 to 20, carbon atoms, for example N-(ethylsulfamoyl)carbamoyl, N-{3-(2,4-di-tert-amylphenoxy)propylsulfamoyl}carbamoyl), N-sulfonylsulfamoyl groups (which have from 0 to 30, and preferably from 1 to 20, carbon atoms, for example N-dodecanesulfonylsulfamoyl, N-benzenesulfonylsulfamoyl), N-carbamoylsulfamoyl groups (which have from 1 to 30, and preferably from 1 to 20, carbon atoms, for example N-(ethylcarbamoyl)sulfamoyl, N-{3-(2,4-di-tert-amylphenoxy)propylcarbamoyl}sulfamoyl), N-(N-sulfonylcarbamoyl)sulfamoyl groups (which have from 1 to 30, and preferably from 1 to 20, carbon atoms, for example N-(dodecanesulfonylcarbamoyl)sulfamoyl, N-(2-octyloxy-5-tert-octylbenzenesulfonylcarbamoyl)sulfamyl, 3-sulfonylureido groups (which have from 1 to 30, and preferably from 1 to 20, carbon atoms, for example 3-hexadecane-sulfonylureido, 3-benzenesulfonylureido), 3-acylureido groups (which have from 2 to 30, and preferably from 2 to 20, carbon atoms, for example 3-acetylureido, 3-benzoylureido), 3-acylsulfamido groups (which have from 1 to 30, and preferably from 1 to 20, carbon atoms, for example 3-propionylsulfamido, 3-(2,4-dichlorobenzoyl)-sulfamido), 3-sulfonylsulfamido groups (which have from 0 to 30, and preferably from 1 to 20, carbon atoms, for example 3-methanesulfonylsulfamido, 3-(2-methoxyethoxy-5-tert-octylbenzenesulfonyl)sulfamido), hydroxyl groups, acyloxy groups (which have from 1 to 30, and preferably from 1 to 20, carbon atoms, for example propanoyloxy, tetradecanoyloxy), sulfonyloxy groups (which have from 0 to 30, and preferably from 0 to 20, carbon atoms, for example decanesulfonyloxy, 2-octyloxy-5-tert-octylbenzenesulfonyloxy), or aryloxycarbonyl groups (which have from 7 to 20, and preferably from 7 to 10, carbon atoms, for example phenoxycarbonyl).

Examples of the preferred substituent groups from among the aforementioned groups when the group represented by A has substituent groups are halogen atoms, alkoxy groups, acylamino groups, carbamoyl groups, alkyl groups, sulfonamido groups and nitro groups, but there are also cases in which no substituent groups are preferred.

Halogen atoms, alkoxycarbonyl groups, sulfamoyl groups, carbamoyl groups, sulfonyl groups, sulfonamido groups, acylamino groups, alkoxy groups, aryloxy groups, N-acylcarbamoyl groups, N-sulfonylcarbamoyl groups, N-sulfamoylcarbamoyl groups, N-sulfonylsulfamoyl groups, N-acylsulfamoyl groups, N-carbamoylsulfamoyl groups and N-(N-sulfonylcarbamoyl)sulfamoyl groups can be cited as preferred examples of the substituent groups when the group represented by Y has substituent groups.

All of the groups conventionally known as coupling leaving groups may be used for the group represented by Z in formula (I). Nitrogen containing heterocyclic groups which are bonded to the coupling position with a nitrogen atom, aromatic oxy groups, aromatic thio groups, heterocyclic oxy groups, hetero-cyclic thio groups, acyloxy groups, carbamoyloxy groups, alkylthio groups or halogen atoms are preferred for Z. These leaving groups may be either photographically useful groups or precursors thereof (for example, development inhibitors, development accelerators, de-silvering accelerators, fogging agents, dyes, film hardening agents, couplers, scavengers for the oxidized form of the developing agent, fluorescent dyes, developing agents or electron transfer agents) or non-photographically useful groups.

When Z represents a nitrogen containing heterocyclic group it is, more precisely, a single ring or condensed ring, substituted or unsubstituted heterocyclic group. Succinimido, maleimido, phthalimido, diglycolimido, pyrrolino, pyrazolyl, imidazolyl, 1,2,4-triazol-2-yl (or -4-yl), 1-tetrazolyl, indolyl, benzopyrazolyl, benzimidazolyl, benzotriazolyl, imidazolidin-2,4-dione-3-yl (or -1-yl), oxazolidin-2,4-dione-3-yl, thiazolidin-2,4-dione-3-yl, imidazolin-2-one-1-yl, oxazolin-2-one-3-yl, thiazolin-2-one-3-yl, benzoxazolin-2-one-3-yl, 1,2,4-triazolidin-3,5-dione-4-yl, 2-pyridon-1-yl, morpholin-3,5-dione-4-yl, 1,2,3-triazol-1-yl and 2-imidazolin-5-one can be cited as examples.

When these heterocyclic groups have substituent groups, these may be the substituent groups cited as substituent groups for the aforementioned A group.

When Z represents a nitrogen containing heterocyclic group it is preferably 1-pyridyl, imidazolyl, 1,2,3-triazol-1-yl, benzotriazolyl, 1,2,4-triazol-1-yl, oxazolidin-2,4-dione-3-yl, 1,2,4-triazolidin-3,5-dione-4-yl or imidazolidin-2,4-dione-3-yl. Those cases in which the groups have substituent groups are also included.

When Z represents an aromatic oxy group it is preferably a substituted or unsubstituted phenoxy group. When the group has substituent groups the substituent groups cited as substituent groups permitted for the groups represented by Y can be cited for these substituent groups. Those cases in which at least one substituent group which is an electron withdrawing group is present as a substituent group on a phenoxy group are preferred, and examples of such substituent groups include a sulfonyl group, an alkoxycarbonyl group, a sulfamoyl group, a halogen atom, a carboxyl group, a carbamoyl group, an acyl group and a nitro group.

When Z represents an aromatic thio group it is preferably a substituted or unsubstituted phenylthio group. When this group has substituent groups they are, for example, the substituent groups cited as substituent groups which are permitted as substituent groups for the group represented by Y. Those cases in which there is at least one alkyl group, alkoxy group, sulfonyl group, alkoxycarbonyl group, sulfamoyl group, halogen atom, carbamoyl or nitro group as a substituent group are preferred when the phenylthio group has a substituent group.

When Z represents a heterocyclic oxy group the heterocyclic group moiety has the same significance as when Y represents a heterocyclic group.

When Z represents a heterocyclic thio group it is preferably a five or six membered unsaturated heterocyclic thio group. A tetrazolylthio group, a 1,3,4-thiadiazolylthio group, a 1,3,4-oxadiazolylthio group, a 1,3,4-triazolylthio group, a benzimidazolylthio group, a benzothiazolylthio group and a 2-pyridylthio group can be cited as examples of such groups. Z may have substituent groups, and those cited earlier as substituent groups permissible when Y represents a heterocyclic group can be cited as such substituent groups. The aromatic groups, alkyl groups, alkylthio groups, acylamino groups, alkoxycarbonyl groups and aryloxycarbonyl groups are especially desirable as substituent groups from among these substituent groups.

When Z is an acyloxy group it is, more precisely, an aromatic acyloxy group (which has from 7 to 11 carbon atoms, and preferably a benzoyloxy group) or an aliphatic acyloxy group (which has from 2 to 20, and preferably from 2 to 10, carbon atoms), and it may have substituent groups. The substituent groups cited earlier as permissible substituent groups when Y represents an aromatic group can be cited as actual examples of such substituent groups. Cases in which there is at least one halogen atom, nitro group, aryl group, alkyl group or alkoxy group as a substituent group are preferred.

When Z represents a carbamoyloxy group it is an aliphatic, aromatic, heterocyclic or unsubstituted carbamoyloxy group which has from 1 to 30, and preferably from 1 to 20, carbon atoms. N,N-Diethylcarbamoyl, N-phenylcarbamoylmorpholinocarbonyloxy, 1-imidazolylcarbonyloxy and N,N-dimethylcarbamoyloxy can be cited as examples. Here, the precise descriptions of alkyl groups, aromatic groups and heterocyclic groups are the same as those given earlier in the description of Y.

When Z represents an alkythio group it is an alkythio group which has from 1 to 30, and preferably from 1 to 20, carbon atoms. The precise description of the alkyl groups is the same as that given earlier in the description of Y.

Five or six membered nitrogen containing heterocyclic groups (bonded to the coupling position with a nitrogen atom), aromatic oxy groups, five or six membered heterocyclic oxy groups and five or six membered heterocyclic thio groups are preferred for the group represented by Z in formula (I).

Aromatic groups are preferred for the group represented by Y in formula (I). Phenyl groups which have at least one substituent group in an ortho-position are especially desirable. The groups described earlier as permissible substituent groups when Y is an aromatic group can be cited as such substituent groups.

When the group represented by Y in formula (I) is a phenyl group which has at least one substituent group in an ortho-position, the substituent group in the ortho-position is most desirably a halogen atom, an alkoxy group, an alkyl group or an aryloxy group.

Those of the couplers represented by formula (I) which can be represented by formula (II) indicated below are especially preferred.

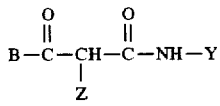

(II)

wherein:

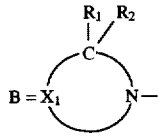

In formula (II), Y and Z have the same meaning as described in connection with formula (I), $X_1$ represents an organic group which is required to form, together with —C($R_1R_2$)—N—, a nitrogen containing heterocyclic group, and $R_1$ and $R_2$ each represents a hydrogen atom or a substituent group.

The meanings of Y and Z in formula (II) and actual examples of these groups are the same as those described in connection with formula (I).

Actual examples of the heterocyclic groups represented by B in formula (II) and examples of substituent groups for these groups are the same as those mentioned in the description of A in formula (I). Furthermore, the preferred numbers of carbon atoms for the heterocyclic groups represented by B and for the substituted groups for B are also the same as those mentioned in the description of A in formula (I). Those cases where a benzene ring is condensed with these heterocyclic groups are especially desirable.

The couplers from among those represented by formula (II) which can be represented by formula (III) indicated below are even more preferred.

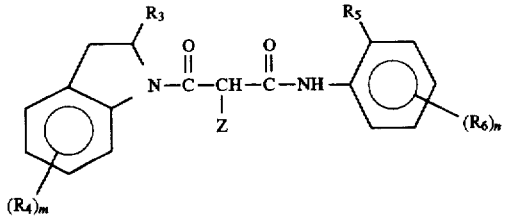

(III)

In formula (III), $R_3$ represents a hydrogen atom or a substituent group, and $R_4$, $R_5$ and $R_6$ represent substituent groups. Z has the same meaning as described in connection with formula (I), and m and n each represents an integer of from 0 to 4. When m and n are integers of 2 or more, the $R_4$ and $R_6$ groups may be the same or different, and they may be joined together to form rings.

When $R_3$ and $R_4$ represent substituent groups in formula (III), examples of these substituent groups are the same as the examples of the substituent groups described when the group represented by A in formula (I) had substituent groups. $R_3$ is preferably a hydrogen atom, an alkyl group or an aryl group, and $R_4$ is preferably a halogen atom, an alkoxy group, an acylamino group, a carbamoyl group, an alkyl group, a sulfonamido group or a nitro group. Moreover, m is preferably an integer of from 0 to 2, and most desirably m is 0 or 1.

Examples of the substituent groups represented by $R_5$ and $R_6$ in formula (III) are the same as the examples of substituent groups described for the group represented by Y in formula (I) when this group has substituent groups. $R_5$ is preferably a halogen atom, an alkoxy group, an alkyl group or an aryloxy group, and $R_6$ is preferably the same as the preferred substituent groups described for the group represented by Y in formula (I) when this group has substituent groups. Moreover, n is preferably an integer of from 0 to 2, and most desirably n is 1 or 2.

The couplers represented by formulae (I), (II) and (III) may form dimers or larger oligomers which are bonded together via divalent groups or groups of valency greater than two in X, Y and Z. In such cases, A, Y, Z, $R_1$, $R_2$, $R_3$, $R_4$, $R_5$ and $R_6$ groups, respectively, may have numbers of carbon atoms greater than the respective numbers of carbon atoms described earlier with respect to A, Y, Z, $R_1$, $R_2$, $R_3$, $R_4$, $R_5$ and $R_6$.

Actual examples of couplers represented by formula (I) are indicated below, but the couplers of formula (I) are not limited by these examples.

TABLE 1

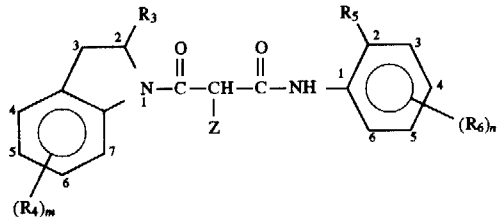

| No. | $R_3$ | m | $R_4$ | $R_5$ | n | $R_6$ | Z |
|---|---|---|---|---|---|---|---|
| 1 | H | 0 | — | $-OCH_3$ | 1 | $-5-SO_2NHCO\underset{\vert}{C}HC_9H_{19}$ (with $C_7H_{15}$) | 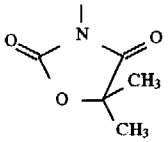 |
| 2 | " | " | — | $-OC_{18}H_{37}(n)$ | 1 | $-5-SO_2NHCO\underset{\vert}{C}HC_4H_9$ (with $C_2H_5$) | " |
| 3 | " | " | — | $-OC_{12}H_{25}(n)$ | 1 | $-5-SO_2NHCONHC_3H_7$ | " |
| 4 | " | " | — | $-O-CH_2\underset{\vert}{C}H-C_8H_{17}(n)$ (with $C_6H_{13}(n)$) | 1 | $-5-SO_2NHCO\underset{\vert}{C}HC_4H_9$ (with $C_2H_5$) | " |
| 5 | H | 0 | — | $-O-\underset{\vert}{C}HCOOC_{12}H_{25}(n)$ (with $CH_3$) | 1 | $-5-SO_2NHCOC_2H_5$ | 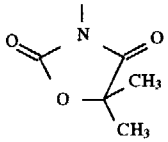 |
| 6 | " | " | — | $-OCH_2\underset{\vert}{C}H$ (with $CH(CH_3)CH_2C(CH_3)_3$ and $(CH_2)_2CH(CH_3)CH_2C(CH_3)_3$) | 1 | $-5-SO_2NHCOC_2H_5$ | " |
| 7 | " | " | — | $-OCH_2COOCH_2\underset{\vert}{C}HC_8H_{17}$ (with $C_{10}H_{21}$) | 1 | $-5-SO_2NHCOCH_3$ | " |
| 8 | " | " | — | 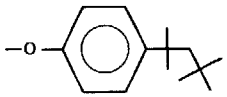 | 1 | $-5-SO_2NHCO\underset{\vert}{C}HC_4H_9$ (with $C_2H_5$) | " |

TABLE 1-continued
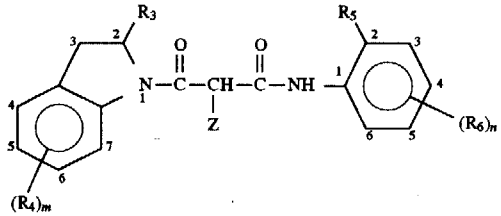
| No. | $R_3$ | m | $R_4$ | $R_5$ | n | $R_6$ | Z |
|---|---|---|---|---|---|---|---|
| 9 | " | " | — | 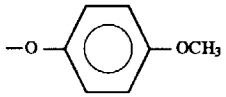 | 1 | $-5-SO_2NHCOCH(C_7H_{15})-C_9H_{19}$ | " |
| 10 | H | 0 | — | 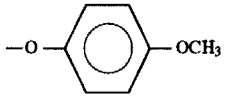 | 1 | $-5-CONHSO_2C_{12}H_{25}$ | 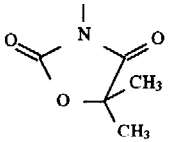 |
| 11 | " | " | — | 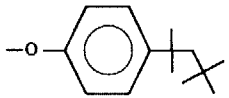 | 1 | $-4-SO_2NHCOC_9H_{19}$ | " |
| 12 | " | " | — | " | 2 | $-4-Cl-5-CONHSO_2C_{16}H_{33}(n)$ | " |
| 13 | " | " | — | " | 2 | $-3-Cl-5-CONHCOC_{11}H_{23}$ | " |
| 14 | " | " | — | $-OCH_3$ | 2 | $-3-Cl-5-CONHSO_2C_{12}H_{25}(n)$ | " |
| 15 | H | 0 | — | $-OC_{16}H_{33}(n)$ | 1 | 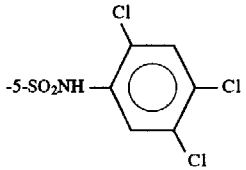 | 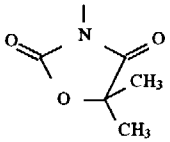 |

TABLE 1-continued
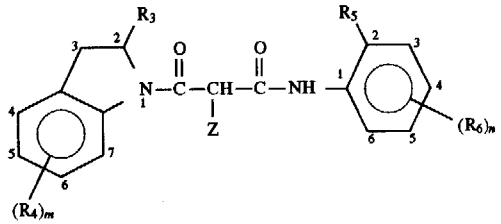
| No. | $R_3$ | m | $R_4$ | $R_5$ | n | $R_6$ | Z |
|---|---|---|---|---|---|---|---|
| 16 | " | " | — | $-OCH_2CH(C_6H_{13})C_8H_{17}$ | 1 | 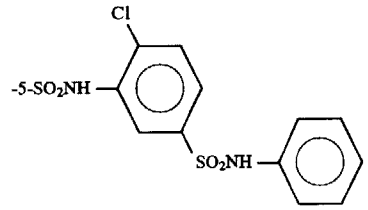 | " |
| 17 | " | " | — | $-OCH(CH_3)_2$ | 1 | 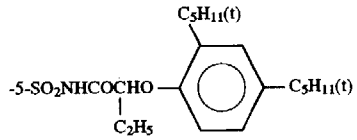 | " |
| 18 | " | " | — | $-OC_{18}H_{37}(n)$ | 1 | 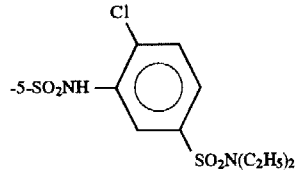 | " |
| 19 | H | 0 | — | 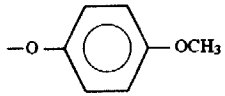 | 1 | 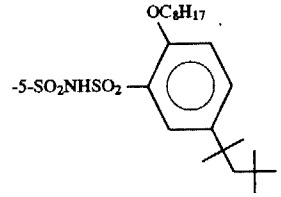 | 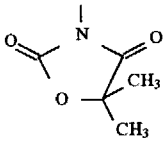 |

TABLE 1-continued
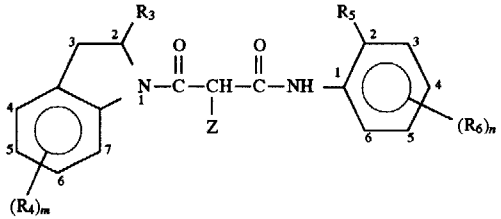
| No. | $R_3$ | m | $R_4$ | $R_5$ | n | $R_6$ | Z |
|---|---|---|---|---|---|---|---|
| 20 | " | " | — | $-OC_2H_5$ | 1 | " | 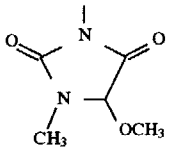 |
| 21 | " | " | — | $-OC_{18}H_{37}(n)$ | 2 | -4-Cl-5-$CONHSO_2C_{12}H_{25}$ | 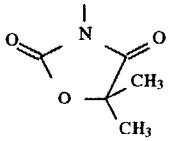 |
| 22 | " | " | — | " | 1 | 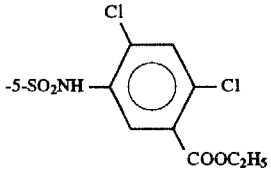 | " |
| 23 | H | 0 | — | 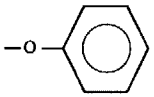 | 1 | 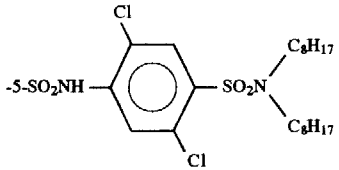 | 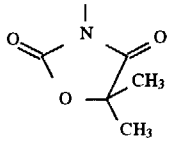 |

TABLE 1-continued
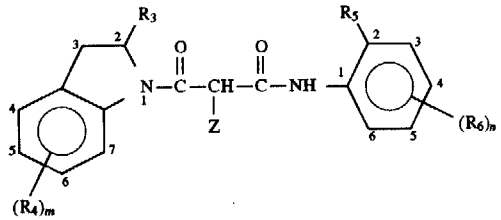
| No. | $R_3$ | m | $R_4$ | $R_5$ | n | $R_6$ | Z |
|---|---|---|---|---|---|---|---|
| 24 | " | " | — | $-OCH(CH_3)_2$ | 1 | 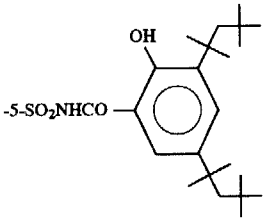 | " |
| 25 | $CH_3$ | " | — | $-OC_2H_5$ | 1 | $-5-SO_2NHCO\overset{C_7H_{15}}{\overset{\vert}{C}}HC_9H_{19}$ | " |
| 26 | H | " | — | $-OC_{18}H_{37}(n)$ | 1 | 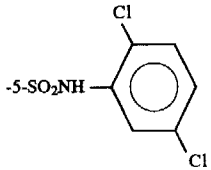 | 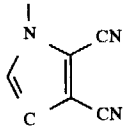 |
| 27 | H | 0 | — | 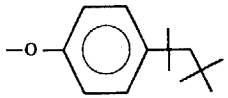 | 1 | 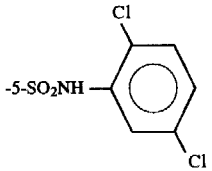 | 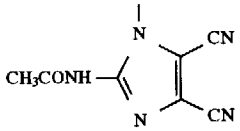 |
| 28 | " | 0 | — | $-OC_{16}H_{33}(n)$ | 1 | $-5-SO_2NHCOC_2H_5$ | 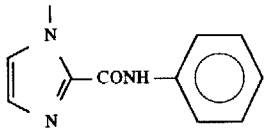 |

TABLE 1-continued
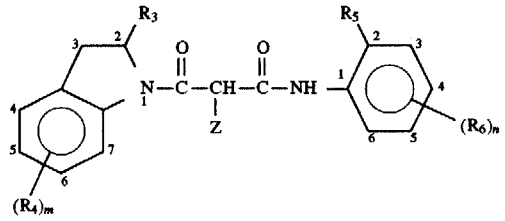
| No. | $R_3$ | m | $R_4$ | $R_5$ | n | $R_6$ | Z |
|---|---|---|---|---|---|---|---|
| 29 | " | 0 | — | −Cl | 1 | -5-CONHSO$_2$−C$_{16}$H$_{33}$(n) | 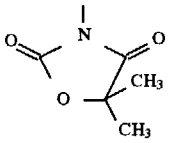 |
| 30 | " | 0 | — | " | 1 | -5-NHCOCH(CH$_3$)CH$_2$SO$_2$C$_{12}$H$_{25}$ | 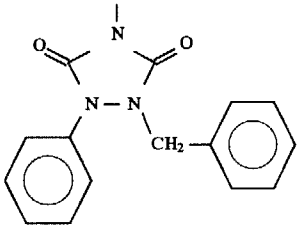 |
| 31 | H | 0 | — | −Cl | 1 | 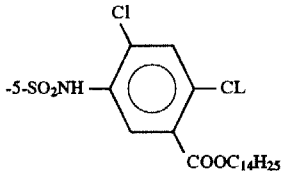 | 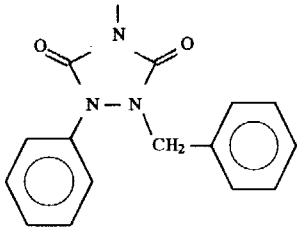 |

TABLE 1-continued
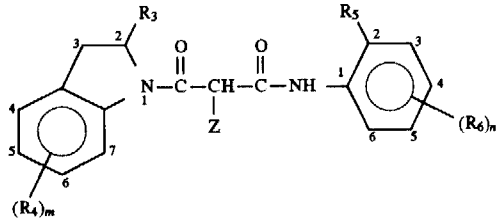
| No. | $R_3$ | m | $R_4$ | $R_5$ | n | $R_6$ | Z |
|---|---|---|---|---|---|---|---|
| 32 | " | 0 | — | " | 2 | -4-Cl-5-$COOC_{12}H_{25}$ | 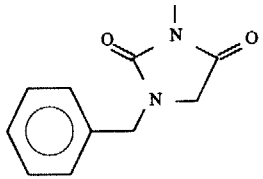 |
| 33 | " | 0 | — | " | 2 | 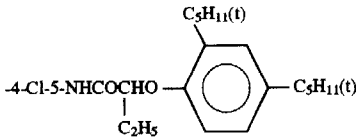 | 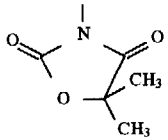 |
| 34 | " | 0 | — | " | 1 | -5-$SO_2NHC_{12}H_{25}$ | " |
| 35 | " | 0 | — | " | 1 | -5-$SO_2NHSO_2C_{16}H_{33}$(n) | 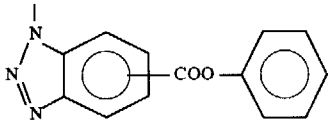 |
| 36 | H | 1 | 5-$NO_2$ | −Cl | 1 | 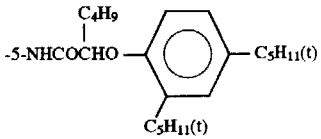 | 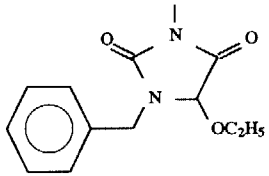 |
| 37 | " | 2 | 5,7-Br | " | 1 | -5-$NHSO_2C_{16}H_{33}$(n) | " |

TABLE 1-continued
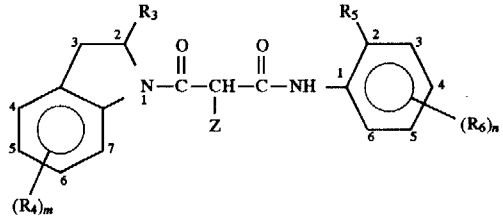
| No. | $R_3$ | m | $R_4$ | $R_5$ | n | $R_6$ | Z |
|---|---|---|---|---|---|---|---|
| 38 | " | 0 | — | $-C_{18}H_{37}(n)$ | 1 | 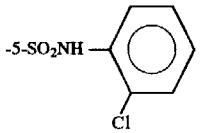 | 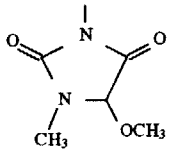 |
| 39 | " | 0 | — | " | 1 | " | 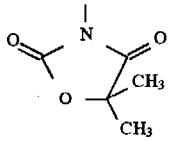 |
| 40 | " | 0 | — | $-OCH_2CH(C_8H_{17})-C_{10}H_{21}$ | 1 | 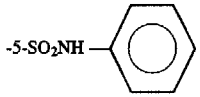 | " |
| 41 | H | 1 | 5-Cl | $-Cl$ | 1 | $-5-NHSO_2C_{16}H_{33}$ | 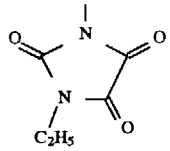 |
| 42 | 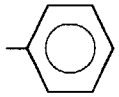 | 1 | $5-NO_2$ | $-OC_{14}H_{29}$ | 1 | 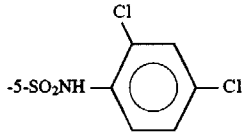 | 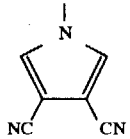 |

TABLE 1-continued
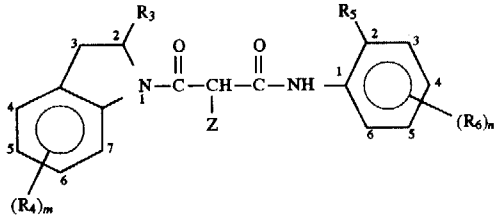
| No. | $R_3$ | m | $R_4$ | $R_5$ | n | $R_6$ | Z |
|---|---|---|---|---|---|---|---|
| 43 | H | 1 | 5-Br | −Cl | 1 | $-5-COOCOOC_{12}H_{25}$ (CH$_3$) | 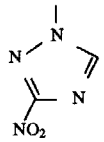 |
| 44 | H | 1 | " | " | 1 | " | 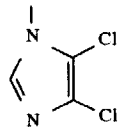 |
| 45 | " | 1 | 5-Cl | " | 1 | $-5-NHSO_2C_{12}H_{25}$ | 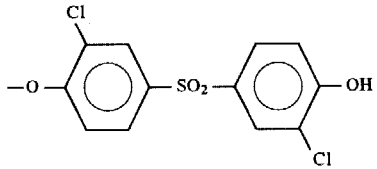 |
| 46 | H | 1 | $5-NO_2$ | −Cl | 1 | $-5-NHSO_2C_{12}H_{25}$ | 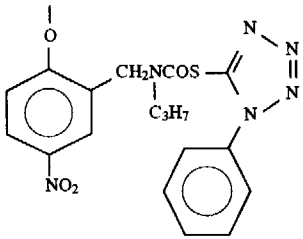 |

TABLE 1-continued
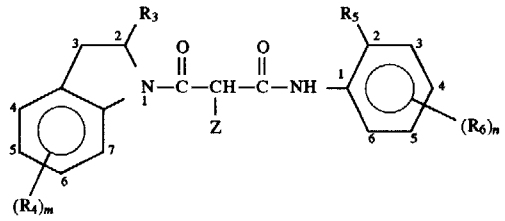
| No. | $R_3$ | m | $R_4$ | $R_5$ | n | $R_6$ | Z |
|---|---|---|---|---|---|---|---|
| 47 | " | 0 | — | " | 1 | 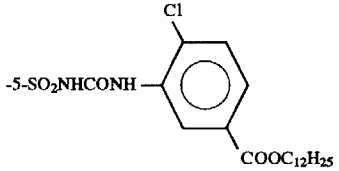 | 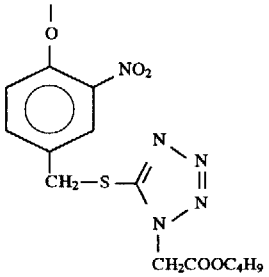 |
| 48 | " | 1 | 5-$OCH_3$ | " | 2 | -4-Cl-5-$COOC_{12}H_{25}$ | 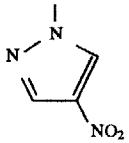 |
| 49 | " | 1 | 5-$NO_2$ | $-CF_3$ | 1 | 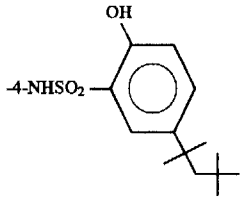 | 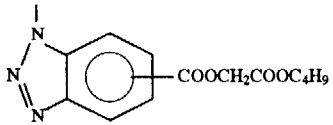 |
| 50 | H | 0 | — | $-OC_2H_5$ | 1 | -5-$SO_2C_{12}H_{25}$ | 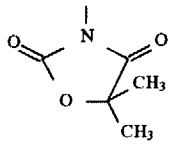 |

TABLE 1-continued
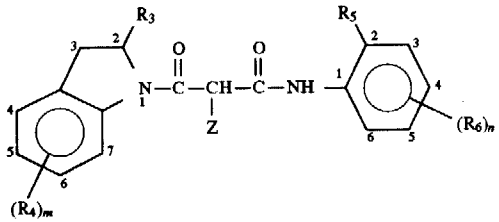
| No. | $R_3$ | m | $R_4$ | $R_5$ | n | $R_6$ | Z |
|---|---|---|---|---|---|---|---|
| 51 | " | 0 | — | −Cl | 1 | 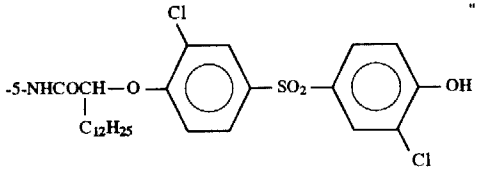 | " |
| 52 | $C_2H_5$ | 0 | — | " | 1 | 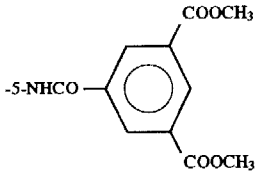 | 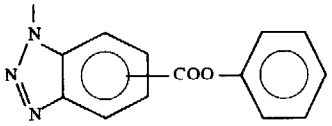 |
| 53 | H | 0 | — | | 1 | 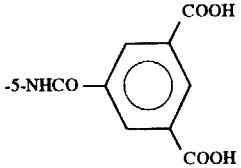 | 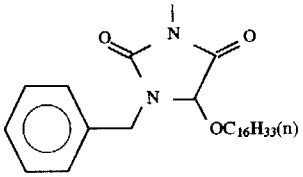 |
| 54 | H | 0 | — | Cl | 1 | $-5-SO_2NHCOC_{11}H_{23}$ | 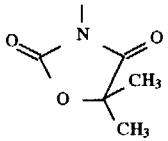 |

TABLE 1-continued
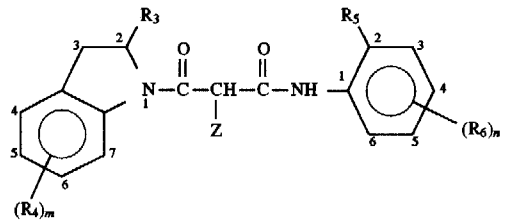
| No. | $R_3$ | m | $R_4$ | $R_5$ | n | $R_6$ | Z |
|---|---|---|---|---|---|---|---|
| 55 | H | 0 | — | 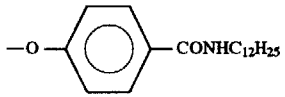 | 1 | 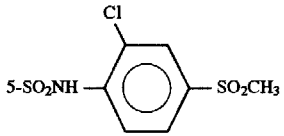 | 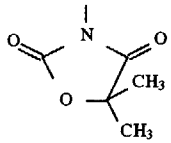 |
| 56 | H | 1 | Br | 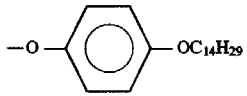 | 1 | 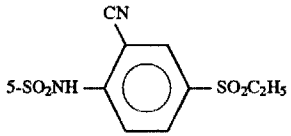 | " |
| 57 | H | 0 | — | 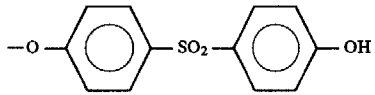 | 1 | 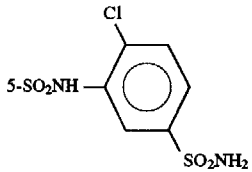 | " |
| 58 | H | 0 | — | 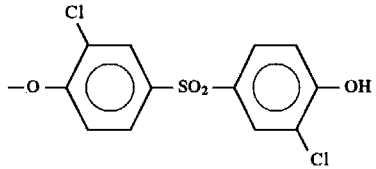 | 1 | $5\text{-}SO_2NHC_{14}H_{29}$ | 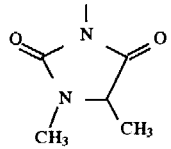 |
| 59 | " | " | — | 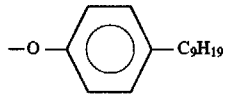 | 1 | $5\text{-}SO_2NHCONHC_{12}H_{25}$ | 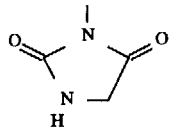 |

TABLE 1-continued
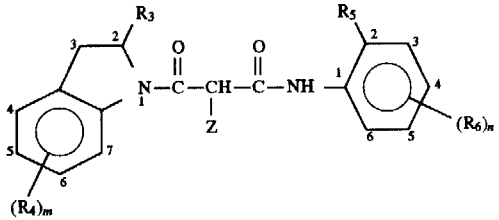
| No. | $R_3$ | m | $R_4$ | $R_5$ | n | $R_6$ | Z |
|---|---|---|---|---|---|---|---|
| 60 | " | " | — | 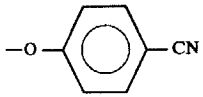 | 1 | 5-$NHSO_2C_{16}H_{33}$(n) | 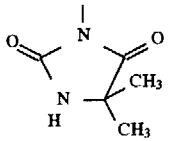 |
| 61 | " | " | — | 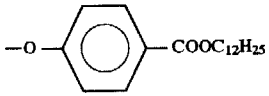 | 1 | 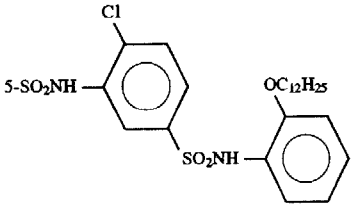 | 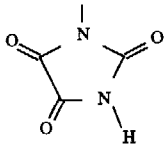 |
| 62 | H | 0 | — | 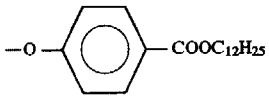 | 1 | 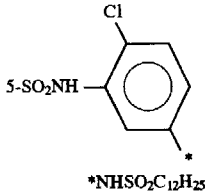 | 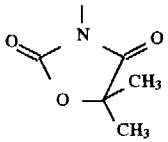 |
| 63 | " | 1 | 5-$NO_2$ | " | 1 | " | 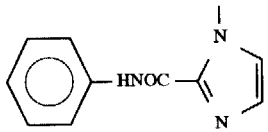 |

TABLE 1-continued
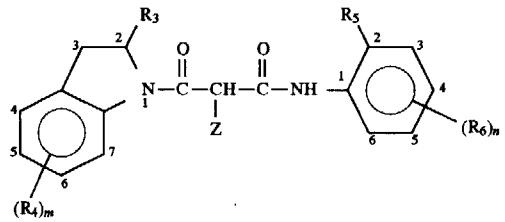
| No. | $R_3$ | m | $R_4$ | $R_5$ | n | $R_6$ | Z |
|---|---|---|---|---|---|---|---|
| 64 | " | 1 | 5-$NHSO_2CH_3$ | 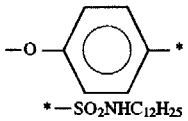 | 1 | 5-$SO_2NH_2$ | 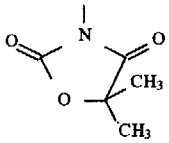 |
| 65 | " | 0 | — | 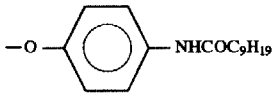 | 2 | 4-Cl-5-$CONH(CH_2)_3$* 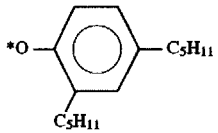 | " |
| 66 | $-CH_3$ | 1 | 5-Br | 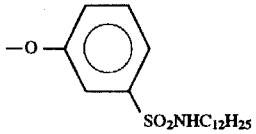 | 1 | 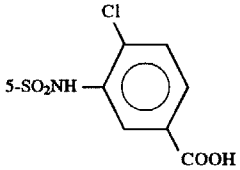 | 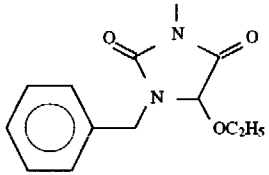 |
| 67 | H | 0 | — | 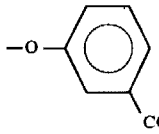 | 1 | 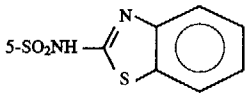 | 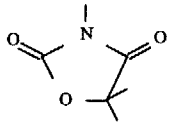 |
| 68 | " | 1 | 5-Br | $-OC_{12}H_{25}$ | 1 | 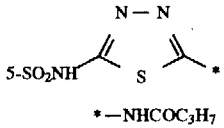 | " |

TABLE 1-continued
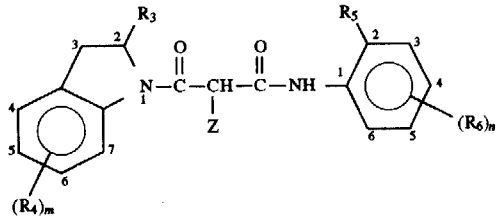
| No. | $R_3$ | m | $R_4$ | $R_5$ | n | $R_6$ | Z |
|---|---|---|---|---|---|---|---|
| 69 | " | 0 | — | 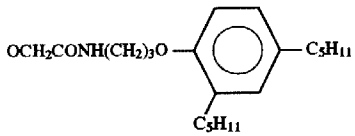 | 1 | 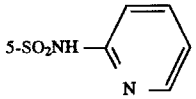 | " |
| 70 | " | 0 | — | 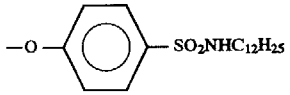 | 1 | 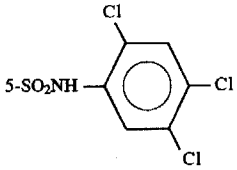 | 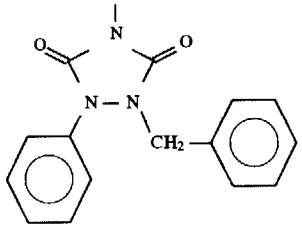 |

TABLE 2
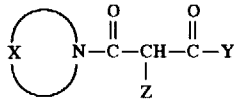
| No. | 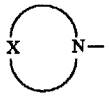 | Y | Z |
|---|---|---|---|
| 71 | 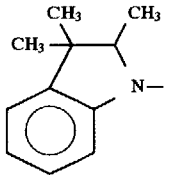 | 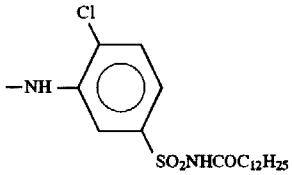 | 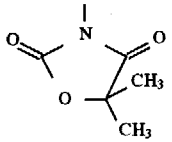 |
| 72 | 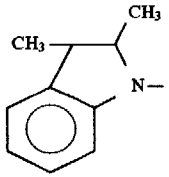 | 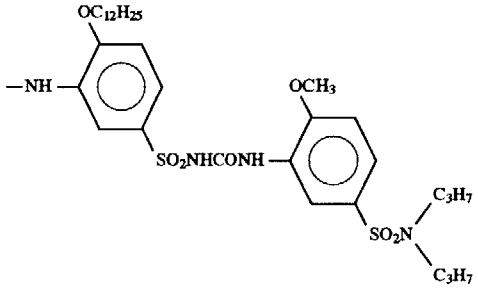 | " |
| 73 | 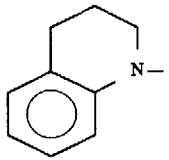 | 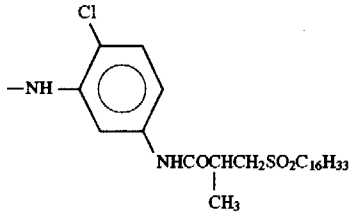 | 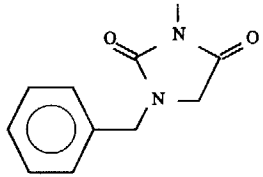 |

TABLE 2-continued
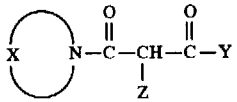
| No. | 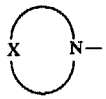 | Y | Z |
|---|---|---|---|
| 74 | 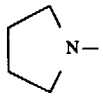 | 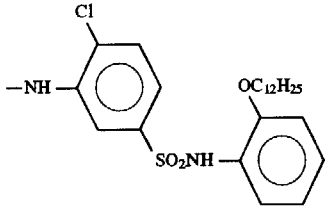 | 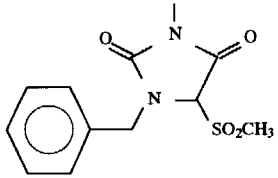 |
| 75 | 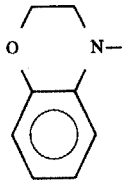 | 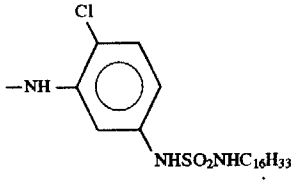 | 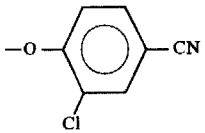 |
| 76 | 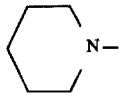 | 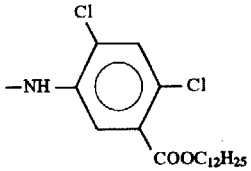 | 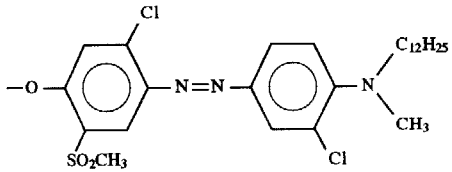 |
| 77 | 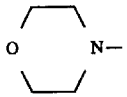 | 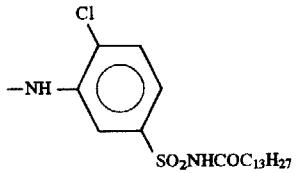 | 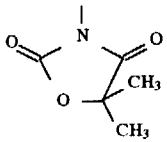 |

TABLE 2-continued
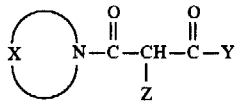
| No. | 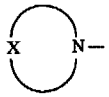 | Y | Z |
|---|---|---|---|
| 78 | 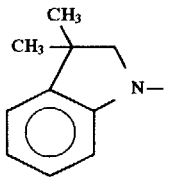 | 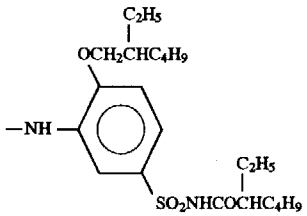 | $SCH_2COOH$ |
| 79 | 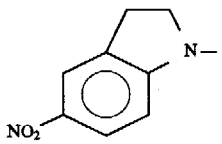 | 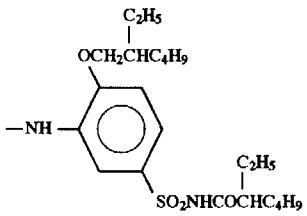 | 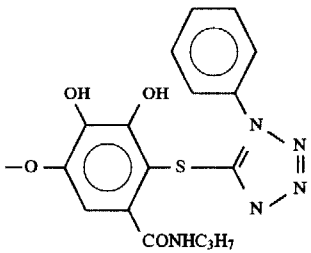 |
| 80 | " | " | 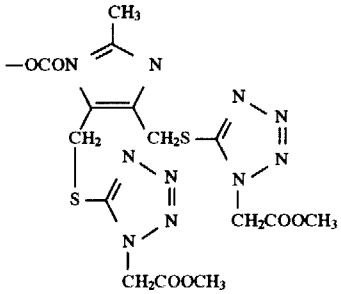 |

TABLE 2-continued
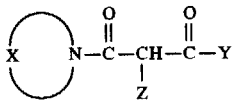
| No. | 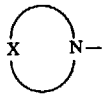 | Y | Z |
|---|---|---|---|
| (81) | | 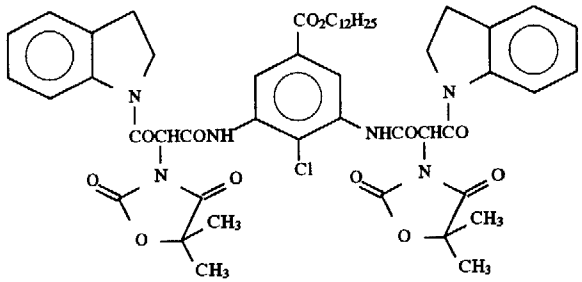 | |
| (82) | | 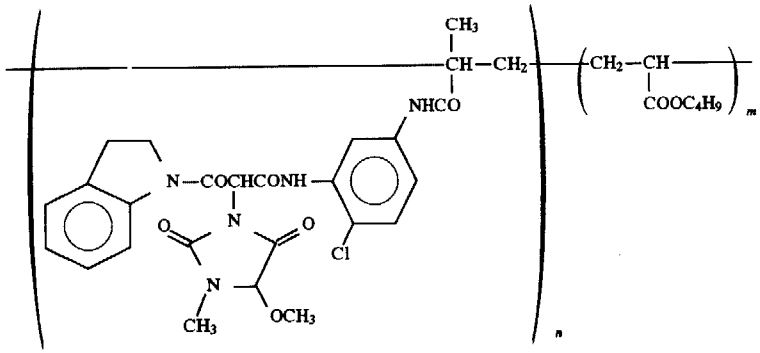 n/m = 50/50 (ratio by weight) Average Molecular Weight 25,000 | |

The compounds of the present invention can be prepared in general using methods which are already known or methods which are similar to these methods.

For example, they can be prepared using the synthetic route indicated below.

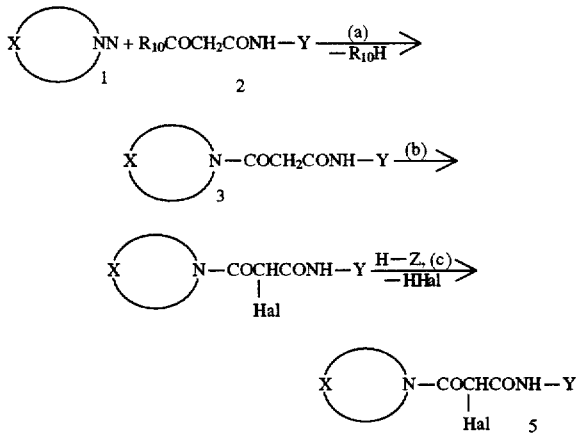

(Compound represented by formula (I))

In these equations, X, Y and Z have the same meanings as described in connection with formula (I). $R_{10}$ represents a halogen atom (for example chlorine), —OH, an alkoxy group (for example, methoxy, ethoxy) or a phenoxy group (for example, phenoxy, 4-nitrophenoxy). Hal represents a halogen atom. The reaction step (a) is carried out using a dehydrating condensing agent (for example N,N-dicyclohexylcarboximide or N,N-diisopropyl-carboximide) when $R_{10}$ is OH. When $R_{10}$ is a halogen atom the reaction step (a) is carried out in the presence of a dehydrohalogenating agent. An organic base (for example, triethylamine, diisopropylethylamine, pyridine, guanidine, potassium butoxide) or an inorganic base (for example, sodium hydroxide, potassium hydroxide, sodium hydride, potassium carbonate), for example, is used for the dehydrohalogenating agent. A halogenating agent is used for reaction step (b) for the reaction: compound 3→compound 4. For example, bromine, chlorine, N-bromosuccinimide or N-chlorosuccinimide may be used. A dehydrohalogenating agent is generally used for reaction step (c) in the reaction: compound 4→final product represented by compound 5. The aforementioned organic and inorganic bases can be cited as examples. A reaction solvent is generally used for each reaction. For example, chlorine based solvents (for example dichloromethylene), aromatic solvents (for example benzene, chlorobenzene, toluene), amide based solvents (for example N,N-dimethylformamide, N,N-dimethylacetamide, N-methylpyrrolidone), nitrile based solvents (for example acetonitrile, propionitrile), ether based solvents (for example tetrahydrofuran, ethylene glycol diethyl ether), sulfone based solvents (for example dimethylsulfone, sulfolane) or hydrocarbon solvents (for example cyclohexane, n-hexane) can be used as solvents.

The compounds of the present invention can also be prepared using methods other than the synthetic route indicated above. For example, they can be prepared using the method described in *J. Org. Chem.*, 29, 2932 (1964). Furthermore, there are cases in which further conversion of functional groups is carried out from compound 5 to derive the final target product. These modifications of the synthetic route and additional reactions can be selected appropriately.

Actual methods of preparation are described below. Other illustrative compounds can also be prepared in the same way.

SYNTHESIS EXAMPLE 1

Preparation of Illustrative Compound (54)

Illustrative Compound (54) was prepared using the method of synthesis described below.

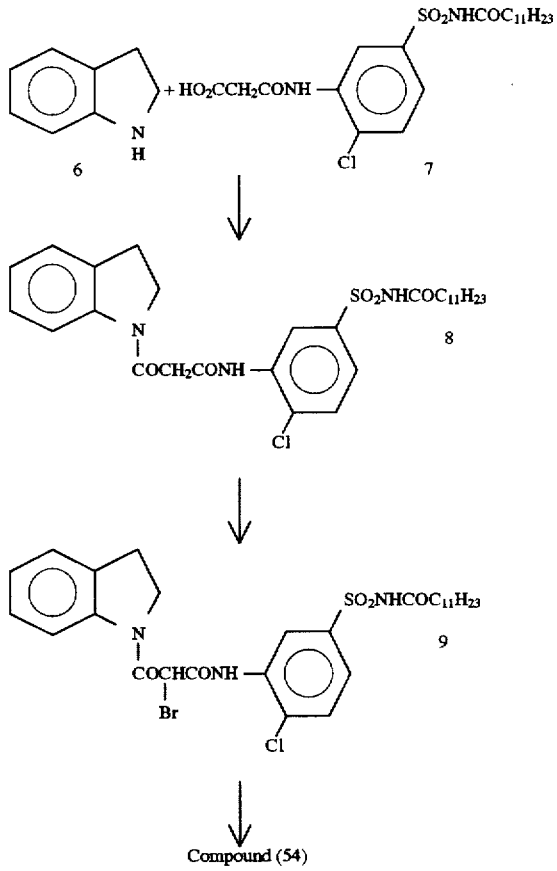

Compound 6 (3.5 grams) and 14 grams of Compound 7 were dissolved in 100 ml of N,N-dimethylformamide and 100 ml of acetonitrile. An acetonitrile (40 ml) solution in which 6 grams of N,N'-dicyclohexylcarbodiimide had been dissolved was added dropwise to this solution at room temperature. The N,N'-dicyclohexylurea which precipitated out after reacting for 2 hours was filtered off. The filtrate was poured into 500 ml of water and extracted with 500 ml of ethyl acetate. The oil layer was recovered using a separating funnel and, after being washed with water, it was dried over sodium sulfate. The solvent was then distilled off under reduced pressure, hexane was added to the residue and the residue crystallized. Compound 8 (17.2 grams) was obtained.

Next, 16 grams of Compound 8 was mixed with 150 ml of dichloromethane. A solution of 10 ml of dichloromethane which contained 4.8 grams of bromine was added dropwise with ice cooling (5° C. to 10° C.). After reacting for 10 minutes, the mixture was transferred to a separating funnel and washed with water. The oil layer (a solution containing Compound 9) was recovered and used without further treatment in the next process.

5,5-Dimethyl-2,4-dioxo-1,3-oxazolidine (8.1 grams) and 8.8 ml of triethylamine were added to 160 ml of N,N-dimethylformamide. The dichloromethane solution of Compound 9 obtained above was added dropwise into this solution at room temperature. After reacting for 1 hour, 500 ml of ethyl acetate was added and the mixture was transferred to a separating funnel and washed with water. After neutralization with dilute hydrochloric acid, the mixture was washed again with water and then the oil layer was separated. The solvent was removed under reduced pressure and the residue was separated and refined using column chromatography. Silica gel was used as the packing material and a mixture of ethyl acetate and hexane (1/1) was used as the eluting solvent. The fractions containing the target Illustrative Compound (54) were collected and 15.2 grams of the wax-like Illustrative Compound (54) were obtained on distilling off the solvent under reduced pressure.

SYNTHESIS EXAMPLE 2

Preparation of Illustrative Compound (2)

The preparation was carried out in the same way as described above in Synthesis Example 1. However, an equimolar quantity of the Compound 10 indicated below was used in place of Compound 7.

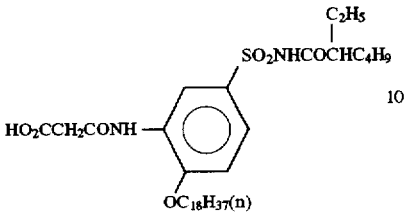

The final material was refined using column chromatography and 18.3 grams of the wax-like Illustrative Compound (2) were obtained.

The amount of the coupler represented by formula (I) of the present invention included in the photosensitive material is from $1\times10^{-3}$ mol to 1 mol, and preferably from $2\times10^{-3}$ mol to $5\times10^{-1}$ mol, per mol of the silver halide in the coupler-containing layer.

The couplers used in the present invention can be introduced into the photosensitive material using various known methods of dispersion. These include the oil-in-water dispersion method, the latex dispersion method, and a method of dispersion with organic solvent soluble polymers. The oil-in-water dispersion method in which the coupler is dissolved in a high boiling point organic solvent (using a low boiling point organic solvent conjointly, as required), emulsified and dispersed in an aqueous gelatin solution and then added to the silver halide emulsion is preferred.

Examples of high boiling point organic solvents which are preferably used in the oil-in-water dispersion method have been disclosed, for example, in U.S. Pat. No. 2,322,027.

Actual examples of the processes and effects of the latex dispersion method and latexes for loading purposes as a polymer dispersion method have been disclosed, for example, in U.S. Pat. No. 4,199,363, West German Patent Applications (OLS) 2,541,274 and 2,541,230, JP-B-53-41091 and European Patent Laid Open (EP) 029,104.

A method of dispersion with organic solvent soluble polymers has been disclosed in PCT International Patent Laid Open No. WO88/00723, and these can also be used desirably in the present invention. (The term "JP-B" as used herein signifies an "Examined Japanese patent publication".)

Furthermore, the use of the compounds disclosed on pages 21 to 71 of European Patent 0,435,179A during emulsification and dispersion is desirable.

The high boiling point organic solvent can be used in amounts of from 0 to 6.0 times by weight, and preferably of from 0 to 4.0 times by weight, with respect to the coupler.

The method of forming a colored image of the present invention can be applied to photosensitive materials such as, for example, color papers, color reversal papers, direct positive color photosensitive materials, color negative films, color positive films and color reversal films. Its application to color photosensitive materials which have a reflective support (for example color papers and color reversal papers) from among these is preferred.

The silver halide emulsion used in the present invention preferably has high silver chloride grains in which from 0.01 mol % to 3 mol % of silver iodide is included at the grain surface, as disclosed in JP-A-3-84545, with a view to increasing the photographic speed at high brightness levels, or increasing the infrared spectrally sensitized photographic speed and increasing stability. The silver halide emulsion used in the present invention is preferably a high silver chloride emulsion having a silver chloride content of at least 95% mol %. Furthermore, the use of an emulsion containing essentially silver iodide free silver chlorobromide or silver chloride is desirable for speeding up the development processing time. Here, the term "essentially silver iodide free" signifies that the silver iodide content is not more than 1 mol %, and preferably not more than 0.2 mol %. The halogen composition of the emulsion may differ from grain to grain, or it may be uniform, but it is easier to make the nature of the grains homogeneous if an emulsion in which the halogen composition is uniform from grain to grain is used. Furthermore, the silver halide composition distribution within the silver halide emulsion grains may be selected appropriately and grains which have a so-called uniform structure in which the composition is uniform throughout the grains, grains which have a so-called layer type structure in which the halogen composition in the core which forms the interior of the silver halide grains and in the surrounding shell part of the grains (the shell may be a single layer or a plurality of layers) is different, or grains which have a structure in which there are parts which have a different halogen composition in a non-layer like form within the grains or on the surfaces of the grains (structures such that parts which have a different halogen composition are joined onto the edges, corners or surfaces of the grains where the parts which have a different composition are at the surface of the grains), can be used. The use of grains of either of the latter two types is preferable to the use of grains which have a uniform structure for obtaining a high photographic speed, and it is also preferred from the point of view of pressure resisting properties. In those cases where the silver halide grains have a structure such as those indicated above, the boundary region between the parts which have different halogen compositions may be a distinct boundary, or it may be an indistinct boundary where a mixed crystal is formed according to the difference in composition, or it may be such that there is a positive and continuous change in the structure.

Furthermore, the use of so-called high silver chloride emulsions which have a high silver chloride content is preferred in photosensitive materials which are suited to rapid processing as in the present invention. The silver chloride content of a high silver chloride emulsion in the present invention is preferably at least 95 mol %, and most desirably at least 97 mol %.

Structures in which the grains in these high silver chloride emulsions have a silver bromide local phase in the form of a layer as described earlier or in a form other than a layer within the silver halide grains and/or at the grain surface are preferred. The halogen composition of the above mentioned local phase preferably has a silver bromide content of at least 10 mol %, and most desirably of at least 20 mol %. These local phases can be within the grains or at the edges or corners of the grain surface or on the surfaces of the grains, and in one preferred example the phase is grown epitaxially on the corners of the grains.

Furthermore, raising the silver chloride content of the silver halide emulsion is also effective for reducing the replenishment rate of the development processing bath. In such a case the use of a virtually pure silver chloride emulsion which has a silver chloride content of from 98 to 100 mol % is also desirable.

The average grain size of the silver halide grains included in the silver halide emulsions used in the present invention is preferably 0.1 μm to 2 μm (the average grain size is the numerical average of the grain size which is taken to be the diameter of a circle having an area equal to the projected area of the grain).

Furthermore, the grain size distribution is preferably that of a so-called mono-dispersion of which the variation coefficient (the value obtained by dividing the standard deviation of the grain size distribution by the average grain size) is not more than 20%, and most desirably not more than 15%. At this time, the use of blends of the above mentioned mono-dispersions in the same layer, or the lamination coating of mono-dispersions, is desirable for obtaining a wide latitude.

The silver halide grains which are included in the photographic emulsion may have a regular crystalline form such as a cubic, tetradecahedral or octahedral form, an irregular crystalline form such as a spherical or plate-like form, or a form which is a composite of such crystalline forms. Furthermore, mixtures of grains which have various crystalline forms may be used. From among these, at least 50%, preferably at least 70%, and most desirably at least 90%, of grains which have the above mentioned regular crystalline form should be included in the present invention.

Furthermore, the use of emulsions in which tabular grains which have an average aspect ratio of at least 5, and preferably of at least 8, account for more than 50% of all the grains in terms of projected area is also desirable. The average aspect ratio is defined as the average of the diameters of the circles having areas equal to the projected areas of the grains divided by the average thickness of the grains.

The silver chlorobromide emulsions used in the present invention can be prepared using the methods disclosed, for example, by P. Glafkides in *Chimie et Phisigue Photographique*, published by Paul Montel, 1967, by G. F. Duffin in *Photographic Emulsion Chemistry*, published by Focal Press, 1966, and by V. L. Zelikman et al. in *Making and Coating Photographic Emulsion*, published by Focal Press, 1964. That is to say, they can be prepared using acidic methods, neutral methods and ammonia methods for example, and a single sided mixing procedure, a simultaneous mixing procedure, or a combination of such procedures, can be used for reacting the soluble silver salt with the soluble halogen salt. Methods in which the grains are formed in the presence of an excess of silver ions (so-called reverse mixing methods) can also be used. The method in which the pAg value in the liquid phase in which the silver halide is being formed is held constant, which is to say the so-called controlled double jet method, can also be used as one type of simultaneous mixing procedure. It is possible to obtain silver halide emulsions with an almost uniform grain size with a regular crystalline form if this method is used.

The inclusion of various multi-valent metal ions or complex ions in the local phase or in the substrate of the silver halide grains of the present invention is desirable. The preferred metal ions are selected from among the metal ions and metal complexes of group VIII or IIb of the periodic table, and lead ion and thallium ion. Combinations of ions or complex ions selected from among iridium, rhodium, iron and the like can be employed in the local phase and combinations of metal ions or complex ions selected from among osmium, iridium, rhodium, platinum, ruthenium, palladium, cobalt, nickel, iron and the like can be employed in the substrate. Furthermore, the type and concentration of the metal ions can be different in the local phase and the substrate. A plurality of these metals may be used.

According to the present invention, the silver halide emulsion which is used in a photosensitive material for scanning exposure purposes using a high density light such as a laser must be suitable for exposure at high brightness levels and it must have a gradation such that the required density appears within the exposure control range of the laser. Moreover, in cases where an infrared semiconductor laser is to be used, the silver halide emulsion must be spectrally sensitized to infrared, but the stability of infrared sensitizing dyes is very poor and the storage properties of the photosensitive material must be improved. With this in view, the use of iridium, rhodium, tellurium or iron ions or complex ions from among the above mentioned metal ions is especially useful. The amount of these metal ions or complex ions used differs greatly according to the composition and size of the silver halide emulsions which are being doped and the location of the doping, but with iridium and rhodium ions the use of from $5\times10^{-9}$ mol to $1\times10^{-4}$ mol per mol of silver is desirable, and with iron ions the use of from $1\times10^{-7}$ mol to $5\times10^{-3}$ mol per mol of silver is desirable.

The compounds which provide these metal ions are included in a local phase and/or in the other parts of the grain (the substrate) of the silver halide grains of the present invention by inclusion in the aqueous gelatin solution which forms the dispersion medium, the aqueous halide solution, the silver nitrate solution or in some other aqueous solution during the formation of the silver halide grains, or they are added in the form of fine silver halide grains which contain the metal ions and the fine grains are dissolved.

The inclusion of the metal ions used in the present invention in the emulsion grains can be carried out before grain formation, during grain formation or immediately after grain formation. This can be varied according to where in the grains the metal ions are to be included.

The silver halide emulsions used in the present invention are generally subjected to chemical sensitization and spectral sensitization.

Chemical sensitization with chalcogen sensitizers (in practical terms, sulfur sensitization as typified by the addition of unstable sulfur compounds or selenium sensitization with selenium compounds or tellurium sensitization with tellurium compounds), precious metal sensitization as typified by gold sensitization, or reduction sensitization may be used individually or conjointly for chemical sensitization. The use of the compounds disclosed from the lower right hand column on page 18 to the upper right hand column of page 22 of JP-A-62-215272 as the compounds which are used for chemical sensitization is desirable.

The emulsions used in the present invention are so-called surface latent image type emulsions with which the latent image is formed predominantly on the surfaces of the grains.

Various compounds or precursors thereof can be added to the silver halide emulsions which are used in the present invention with a view to preventing the occurrence of fogging during the manufacture, storage or photographic processing of the photosensitive material or with a view to stabilizing photographic performance. The compounds disclosed on pages 39 to 72 of the previously mentioned JP-A-62-215272 can be used desirably as actual examples of such compounds. Moreover, use of the 5-arylamino-1,2,3,4-thiatriazole compounds (which have at least one electron withdrawing group on the aryl residual group) disclosed in European Patent EP 0,447,647 is also desirable.

Spectral sensitization is carried out with a view to rendering the emulsion of each layer in a photosensitive material of the present invention spectrally sensitive to light of a prescribed wavelength region. In the present invention the intention is to use monochromatic high density light such as laser light or second harmonic laser light where a laser is combined with a non-linear optical crystal for the light source and so spectral sensitization must be carried out to match the oscillating wavelengths of this light. The execution of spectral sensitization to match these oscillating wavelengths signifies carrying out spectral sensitization using sensitizing dyes which have a spectral sensitivity at the oscillating wavelength, and it does not always signify that only the maximum spectral sensitization sensitivity matches the oscillating wavelength. Matching of the oscillating wavelength and the peak spectral sensitivity wavelength is desirable from the viewpoint of the sensitivity to the laser light beams and color separation, but design of some intentional displacement of the oscillating wavelength and the peak spectral sensitization wavelength is desirable from the point of view of minimizing the variation in photographic speed arising from fluctuations in the oscillating light intensity and the oscillating wavelength due to fluctuations in the temperature of the laser (setting the peak spectral sensitivity on the long wavelength side with respect to the laser oscillating wavelength is especially desirable). The spectrally sensitizing dyes described, for example, by F. M. Harmer in *Heterocyclic Compounds, Cyanine Dyes and Related Compounds*, (John Wiley & Sons [New York, London], 1964) can be cited as spectrally sensitizing dyes which can be used for spectral sensitization in a photosensitive material of the present invention. Use of the compounds and spectral sensitization methods disclosed from the upper right hand column on page 22 to page 38 of the aforementioned JP-A-62-215272 is desirable.

Effective spectral sensitization in the region from red to infrared is needed in cases where semiconductor lasers are to be used for the light source for scanning exposure purposes in the present invention. The sensitizing dyes disclosed from the upper left hand column on page 12 to the lower left hand column of page 21 of JP-A-3-15049, or from the lower left hand column of page 4 to the lower left hand column on page 15 of JP-A-3-20730, from line 21 on page 4 to line 54 on page 6 of European Patent EP 0,420,011, from line 12 of page 4 to line 33 of page 10 of European Patent EP 0,420,012, in European Patent EP 0,443,466 and in U.S. Pat. No. 4,975,362 for spectral sensitization in the region above 730 nm is especially desirable. These sensitizing dyes are distinguished by being comparatively stable in optical terms, by being adsorbed comparatively strongly on silver halide grains, and being strongly desorbed with dispersions of couplers for example which are also present. Compounds which have a reduction potential of −1.05 (V vs SCE) or lower are especially desirable as sensitizing dyes for infrared sensitization purposes and, from among these compounds, those which have a reduction potential of −1.15 or below are preferred. Sensitizing dyes which have this characteristic are effective for increasing photographic speed and, in particular, for stabilizing photographic speed and stabilizing the latent image.

The measurement of reduction potentials can be carried out using phase discrimination type second harmonic alternating current polarography. This is carried out using a dropping mercury electrode for the working electrode, a standard calomel electrode for the reference electrode and platinum for the counter electrode.

Furthermore, the measurement of reduction potentials by means of phase discrimination type second harmonic alternating current voltametry using platinum for the working electrode has been described in *Journal of Imaging Science*, Vol. 30, pages 27 to 35 (1986).

For inclusion in a silver halide emulsion, these spectrally sensitizing dyes may be dispersed directly in the emulsion or they may be dissolved in an individual solvent such as water, methanol, ethanol, propanol, methylcellosolve or 2,2,3,3-tetrafluoropropanol for example, or in a mixture of these solvents, for addition to the emulsion. Furthermore, they may be formed into aqueous solutions which contain acids or bases as disclosed, for example, in JP-B-44-23389, JP-A-44-27555 or JP-A-57-22089, or they can be formed into an aqueous solution or colloidal dispersion in the co-presence of a surfactant, as disclosed for example in U.S. Pat. Nos. 3,822,135 and 4,006,025 for addition to the emulsion. Furthermore, they may be dissolved in a solvent which is essentially immiscible with water such as phenoxyethanol for example and then dispersed in water or in a hydrophilic colloid for addition to the emulsion. Direct dispersion in a hydrophilic colloid as disclosed in JP-A-53-102733 and JP-A-58-105141 with addition of the dispersion to the emulsion can also be employed. The time at which the addition to the emulsion is made may be at any stage during the manufacture which has been known to be useful in the past. Thus the time can be selected from among before the formation of the gains of the silver halide emulsion, during grain formation, before the washing process immediately after grain formation, before chemical sensitization, during chemical sensitization, before cooling and solidifying the emulsion immediately after chemical sensitization or during the preparation of a coating liquid. The addition is usually made at a time after the completion of chemical sensitization and before coating, but the addition can be made at the same time as the chemical sensitization as disclosed in U.S. Pat. Nos. 3,628,969 and 4,225,666 and spectral sensitization can be carried out at the same time as chemical sensitization, or the addition can be made before chemical sensitization as disclosed in JP-A-58-113928, and the addition can also be made and chemical sensitization can be started before the precipitation and formation of the silver halide grains has been completed. Moreover, the addition can be made by dividing the spectrally sensitizing dye, which is to say with the addition of some of the dye before chemical sensitization with the remainder being added after chemical sensitization, as disclosed in U.S. Pat. No. 4,225,666, and the addition can be made at any time during the formation of the silver halide grains based on the method described in U.S. Pat. No. 4,183,756. From among these methods, the addition of the sensitizing dye before washing the emulsion or before chemical sensitization is especially desirable.

The amounts in which these spectrally sensitizing dyes are added vary over a wide range depending on the particular case, and it is preferably from $0.5\times10^{-6}$ mol to $1.0\times10^{-2}$ mol per mol of silver halide. It is most desirably from $1.0\times10^{-6}$ mol to $5.0\times10^{-3}$ mol per mol of silver halide.

In those cases where a sensitizing dye which has a spectral sensitizing sensitivity in the range from red to infrared in particular is used in the present invention, the use of the compounds disclosed from the lower right hand column on page 13 to the lower right hand column on page 22 of JP-A-2-157749 is preferred. By using these compounds it is possible to increase the stability of the storage properties and processing of the sensitive material and to increase the super-sensitizing effect uniquely. The use of compounds of formulae (IV), (V) and (VI) from the same specification conjointly is especially desirable. These compounds are used in amounts of from $0.5\times10^{-5}$ mol to $5.0\times10^{-2}$ mol, and preferably of from $5.0\times10^{-5}$ mol to $5.0\times10^{-3}$ mol, per mol of silver halide, and a useful amount in use is from 1 to 10000 mols, and preferably from 2 to 5000 mols, per mol of sensitizing dye.

The structure of a photosensitive material of the present invention is described below. A photosensitive material of the present invention has at least three silver halide emulsion layers on a support, and at least one silver halide emulsion layer must contain a yellow coupler of the present invention. The photosensitive materials of the present invention may be used for digital scanning exposures in which monochromatic high density light is used, such as that from a gas laser, a light emitting diode, a semiconductor laser, or a second harmonic generating light source (SHG) in which a semiconductor laser or a solid laser in which a semiconductor laser is used as an exciting light source and a non-linear optical crystal are combined. The use of a semiconductor laser or a second harmonic generating light source (SHG) in which a semiconductor laser or a solid laser is combined with a non-linear optical crystal is preferred for providing a compact and cheap system. The use of a semiconductor laser is especially desirable for designing apparatus which is compact, cheap, has a long life and which is very stable, and the use of at least one semiconductor laser as a light source is preferred.

The spectral sensitization peaks of the photosensitive material can be set according to the wavelengths of the scanning exposure light sources which are to be used. It is possible to halve the wavelength of a laser with an SHG light source which is obtained by combining a non-linear optical crystal with a solid laser in which a semiconductor laser is used as the exciting light source or a semiconductor laser and so it is possible to obtain blue light and green light. Hence, the spectral sensitization peaks of the photosensitive material can be the three usual regions of blue, green and red. The provision of at least two layers which have a spectral sensitization peak above 670 nm is desirable for using semiconductor lasers as light sources for providing apparatus which is cheap, compact and highly stable. This is because the oscillating wavelengths of stable groups III–V based semiconductor lasers are at the present time only to be found in the region from red to infrared. However, the oscillation of group II–VI based semiconductor lasers in the green or blue region has been confirmed in the laboratory, and if manufacturing techniques are developed for these semiconductor lasers it can be anticipated that it will be possible to use these semiconductor lasers both cheaply and in a stable manner. In such a case the necessity for having at least two layers with a spectral sensitivity peak of at least 670 nm is reduced.

A photosensitive layer of a photosensitive material of the present invention contains at least one coupler which forms a color by means of a coupling reaction with an oxidation product of an aromatic amine based compound. For full-color hard copy purposes, the provision on a support of at least three silver halide photosensitive layers which have different color sensitivities and the inclusion of couplers which form either the color yellow, the color magenta or the color cyan by means of a coupling reaction with an oxidation product of an aromatic amine based compound in each of these layers are desirable. The three different spectral sensitivities can be selected according to the wavelengths of the light sources which are used for the digital exposure, but a separation of at least 30 nm between the closest spectral sensitization peaks is desirable. No particular limitation is imposed upon the relationship of the yellow, magenta, and cyan color forming couplers (Y, M, C) which are included in the photosensitive layers which have at least three different spectral sensitization peaks ($\lambda_1$, $\lambda_2$, $\lambda_3$). There are 3×2=6 possible combinations, and there are also cases in which from the viewpoint of the resolving power of the human eye it is desirable that the photosensitive layer of longest wavelength should be the yellow color forming layer. Furthermore, no particular limitation is imposed upon the coating order from the support side of the at least three photosensitive layers which have different spectral sensitization peaks, but there are cases where from the viewpoint of rapid processing the location of the photosensitive layer which contains the silver halide grains of which the average grain size is the largest as the uppermost layer is desirable. Moreover, there are also cases where, from the viewpoint of sharpness, the location of the photosensitive layer which has the spectral sensitization of the longest wavelength as the uppermost layer is desirable. Moreover, there are also cases where, from the viewpoint of the storage properties of the hard copy under bright illumination for example, the establishment of the magenta color forming layer as the lowermost layer is desirable. Hence, there are 36 possible combinations of layer orders and three types of couplers, and three spectral sensitivities. The present invention can be used effectively in all 36 types of photosensitive materials. Actual examples of digital light sources, spectral sensitization peaks and color forming couplers are shown in Table 3, but the possibilities are not limited to these examples.

TABLE 3

| | Digital Scanning Exposure Light Source | | | | Spectral Sensitization Peak of the Sensitive Material (nm) |
|---|---|---|---|---|---|
| | Light Source | | Wavelength (nm) | Color Formed[2)] | |
| 1 | AlGaInAs | (670) | 680 | C | 670 |
| | GaAlAs | (750) | 750 | Y | 730 |
| | GaAlAs | (810) | 810 | M | 810 |
| 2 | AlGaInAs | (670) | 670 | Y | 680 |
| | GaAlAs | (750) | 750 | M | 750 |
| | GaAlAs | (830) | 830 | C | 840 |
| 3 | AlGaInAs | (670) | 670 | M | 670 |
| | GaAlAs | (750) | 750 | C | 750 |
| | GaAlAs | (810) | 810 | Y | 820 |
| 4 | AlGaInAs | (670) | 680 | Y | 670 |
| | GaAlAs | (780) | 780 | C | 780 |
| | GaAlAs | (830) | 830 | M | 840 |
| 5 | AlGaInAs | (633) | 633 | Y | 630 |
| | AlGaInAs | (680) | 680 | M | 670 |
| | GaAlAs | (780) | 780 | C | 780 |
| 6 | GaAlAs | (780) | 780 | M | 780 |
| | GaAlAs | (830) | 830 | Y | 830 |
| | GaAlAs | (880) | 880 | C | 880 |
| 7 | YAG + SHG | ($KNbO_3$) | 473 | Y | 470 |
| | $YVO_4$ + SHG | (KTP) | 532 | M | 550 |
| | AlGaInAs | (680) | 680 | C | 700 |
| 8 | GaAs(900) + SHG | | 450 | M | 450 |
| | InGaAs(1200) + SHG | | 600 | C | 580 |
| | AlGaInAs | (680) | 680 | Y | 700 |

TABLE 3-continued

| | Digital Scanning Exposure Light Source | | | | Spectral Sensitization Peak of the Sensitive Material (nm) |
|---|---|---|---|---|---|
| | Light Source | | Wavelength (nm) | Color Formed[2)] | |
| 9 | LED | (580) | 580 | C | 580 |
| | LED | (670) | 670 | M | 670 |
| | LED | (810) | 810 | Y | 810 |

[1)]SHG: A second harmonic obtained using a non-linear optical element was used.
[2)]No limitation is imposed on the order of the color forming layers on the support.

The making of an exposure in the present invention is described below. The photosensitive materials of the present invention are intended for use with a scanning type digital exposure in which the image is exposed by moving relative to the photosensitive material a high density light beam such as that from a gas laser, a semiconductor laser, a second harmonic generating light source in which a semiconductor laser or a solid laser in which a semiconductor laser is used as an exciting light source is combined with a non-linear optical crystal (non-linear optical elements which generate second harmonics have been described in detail in from page 55 of *Optronics*, (1990) No. 12, or in Japanese Patent Application No. 2-032769), or an LED for example. Therefore, a time to expose silver halide in the photographic material to light means "a time to expose a very small area to light". As for the very small area, the smallest unit to enable the control of the quantity of light for exposure based on individual digitized image data is generally used, and it is called a picture element. Accordingly, an exposure time per picture element is changed depending on the size of said picture element. The size of such a picture element depends on the picture element density, and a practical range of the picture element density is from 50 to 2,000 dots per inch. When the exposure time is defined as a time to expose the picture element with a size corresponding to the picture element density of 400 dots per inch, a suitable exposure time is not more than $10^{-4}$ second, especially not more than $10^{-7}$ second.

The control of the quantity of light of a scanning exposure light source which can be used in the present invention is described below.

In cases where an image which has gradation such as hard copy which includes pictorial images is formed on a support in accordance with the objects of the present invention it is necessary to modulate the quantity of light in a number of steps (with at least 6 bits and preferably at least 8 bits) in order to provide a satisfactory picture quality. In the case of semiconductor lasers there are intensity modulation systems in which the light intensity is varied by changing the laser current and pulse width modulation systems in which the quantity of light is varied by changing the exposure time per picture element while the light intensity of the laser is held constant, and these two systems can be used individually or in combination as a means of modulation. The intensity modulation system involves varying the light intensity of the laser and so the amount of heat which is being generated changes according to the amount of exposure and, as a result, the light intensity is difficult to control when compared with the pulse width modulation system and, moreover, the minimum time which can be controlled per picture element is also inevitably longer than with the pulse width modulation system. Hence, the use of pulse width modulation systems is preferred. However, it is difficult to shorten the modulation time per picture element of the pulse modulation system below a few hundred nanoseconds because of problems with the stability of the modulation for example.

Moreover, in the case of modulation at high speed it is desirable that an external modulator should be used. It is possible to realize the highest achievable modulation rate of a few nanoseconds per picture element by using an external modulator.

The external modulators which can be used in the present invention include bulk type acousto-optical modulators, waveguide type acousto-optical modulators and waveguide type electro-optical modulators for example. Bulk type acousto-optical modulators have been described in detail in *The Fundamentals of Opto-electronics*, by Amnon Yariv (translated by Kunio Tada and Takeshi Kamiya (published by Maruzen)). Furthermore, waveguide type acousto-optical modulators have been described in detail in Japanese Patent Application No. 1-267664 and in *Opto-integrated Circuits*, by Nishihara, Haruna and Suhara, published by Ohm Sha (1985). Moreover, waveguide type electro-optical modulators have been described in Japanese Patent Application No. 63-130014 and in the aforementioned book entitled *Opto-integrated Circuits*.

The use from among these of the waveguide type acousto-optical modulators and waveguide type electro-optical modulators is especially desirable from the viewpoint of the build-up rate of the modulator.

The dyes (oxonol dyes and cyanine dyes) which can be decolorized by processing disclosed on pages 27 to 76 of European Patent 0,337,490A2 are preferably added to the hydrophilic colloid layers in a photosensitive material of the present invention with a view to preventing the occurrence of irradiation and halation and with a view to improving safe-light safety for example. Furthermore, the use of dyes which are included in the hydrophilic colloid layers in the form of fine solid particle dispersions and which are decolorized in the development process, such as the dyes disclosed from the upper right hand column on page 3 to page 8 of JP-A-2-282244 and the dyes disclosed from the upper right hand column on page 3 to the lower left hand column on page 11 of JP-A-3-7931 is also desirable. Furthermore, in cases where these dyes are used, the selection and use of dyes which have an absorbance such that it overlaps the spectral sensitization peak of the photosensitive layer of the longest wavelength is preferred. The setting of the optical density (the logarithm of the reciprocal of the optical transmittance) (the reflection density in the case of a reflective support) at the laser wavelength of the photosensitive material to at least 0.5 using these dyes is desirable for improving sharpness.

With these water soluble dyes there are some which have an adverse effect on color separation if the amount used is increased. The water soluble dyes disclosed in Japanese Patent Application No. 3-310143 are preferred as dyes which can be used without adversely affecting color separation.

Moreover, the inclusion of at least 12% by weight (and preferably of at least 14% by weight) of titanium oxide which has been surface treated with a di-hydric to tetra-hydric alcohol (for example trimethylolethane) for example in the water resistant resin layer of the support is desirable for improving sharpness. Moreover, the use of colloidal silver in an anti-halation layer as disclosed in JP-A-1-239544 is also desirable.

The use of compounds for improving the color image storage properties such as those disclosed in European Patent 0,277,589A2 along with the couplers is desirable in a photosensitive material in accordance with the present invention. The conjoint use of such compounds with the yellow couplers and pyrazoloazole couplers which are used in the present invention is especially desirable.

The description of compounds (F) and compounds (G) in European Patent 0,277,589A2 is incorporated by reference herein.

That is to say, the use either independently or conjointly of compounds (F) which bond chemically with aromatic amine based developing agents which remain after color development processing to form compounds which are chemically inert and essentially colorless and/or compounds (G) which bond chemically with the oxidation products of aromatic amine based color developing agents which remain after color development processing and form compounds which are chemically inert and which are essentially colorless is desirable for example for preventing the occurrence of staining due to the formation of colored dyes by the reaction of couplers with color developing agent or the oxidation product of a color developing agent which remains in the film, and other side effects, on storage after processing.

Furthermore, the addition of biocides such as those disclosed in JP-A-63-271247 to a photosensitive material of the present invention is desirable for preventing the growth of various fungi and bacteria which propagate in the hydrophilic colloid layers and cause deterioration of the image.

Furthermore, white polyester based supports for display purposes or supports which have a layer which contains a white pigment provided on the side of the support on which the silver halide emulsion layer is provided may be used for the supports which are used for a photosensitive material of the present invention. Moreover, the coating of an anti-halation layer on the side of the support on which the silver halide emulsion layer is coated or on the reverse side is desirable for improving sharpness. The establishment of a support transmission density of from 0.35 to 0.8 so that the display can be viewed using both reflected light and transmitted light is especially desirable.

Moreover, the use of transparent supports is also desirable for the supports which are used for the photosensitive materials in the present invention. At this time the coating of an anti-halation layer on the silver halide emulsion layer coated side or on the reverse side of the support is desirable.

The exposed photosensitive material can be subjected to the usual color development processing, but in the case of a color photosensitive material of the present invention the use of a bleach-fix process after color development is desirable from the viewpoint of rapid processing. In cases where the aforementioned high silver chloride emulsions are used in particular the pH of the bleach-fixer is preferably not more than about 6.5, and most desirably not more than about 6, from the viewpoint of accelerating de-silvering for example.

The use in a photosensitive material of the present invention of the silver halide emulsions and other materials (additives etc.), the photographic layer structures (layer arrangements etc.) and the methods of processing which are suitable for processing these photosensitive materials and the additives for processing purposes which have been disclosed in the patents indicated below, and especially in European Patent EP0,355,660A2 (Japanese Patent Application No. 1-107011), is desirable.

TABLE 4

| Photographic Structural Element, etc. | JP-A-62-215272 | JP-A-2-33144 | EP0,355,660A2 |
|---|---|---|---|
| Silver Halide Emulsions | Upper right column on page 10, line 6, to lower left column on page 12, line 5, and Lower right column on page 12, fourth line from the bottom, to upper left column on page 13, line 17. | Upper right column on page 28, line 16, to lower right column on page 29, line 11, and page 30, lines 2 to 5. | Page 45 line 53 to page 47 line 3, and page 47 lines 20 to 22 |
| Silver Halide Solvents | Lower left column on page 12, lines 6 to 14, and upper left column on page 13, line 3 from the bottom to lower left column on page 18, last line | — | — |
| Chemical Sensitizers | Page 12, lower left column, line 3 from the bottom to lower right column line 5 from the bottom and lower right column on page 18, line 1, to upper right column on page 22, line 9 from the bottom | Lower right column on page 29 line 12 to the last line. | Page 47, lines 4 to 9 |
| Spectral Sensitizers (Methods of Spectral Sensitization) | Upper right column on page 22, line 8 from the bottom, to last line on page 38 | Upper left column on page 30, lines 1 to 13. | Page 47, lines 10 to 15 |
| Emulsion Stabilizers | Upper left column on page 39, line 1, to upper right right column page 72, last line | Upper left column on page 30, line 14, to upper column on line 1 | Page 47 lines 16 to 19 |
| Development | Lower left column on page | — | — |

TABLE 4-continued

| Photographic Structural Element, etc. | JP-A-62-215272 | JP-A-2-33144 | EP0,355,660A2 |
|---|---|---|---|
| Accelerators | 72, line 1, to upper right column on page 91, line 3 | | |
| Color Couplers (Cyan, Magenta and Yellow Couplers) | Upper right column on page 91, line 4, to upper left column on page 121, line 6 | Upper right column on page 3, line 14, to upper left column on page 18, last line, and upper right column on page 30, line 6, to lower right column on page 35, line 11 | Page 4, lines 15 to 27, page 5 line 30 to the last line on page 28, page 45 lines 29 to 31 and page 47, line 23, to page 63, line 50 |
| Super-sensitizers | Upper left column on page 121, line 7, to upper right column on page 125, line 1 | — | — |
| Ultraviolet Absorbers | Upper right column on page 125, line 2, to lower left column on page 127, last line | Lower right column on page 37, line 14, to upper left column on page 38, line 11 | Page 62, lines 22 to 31 |
| Anti-fading Agents (Image Stabilizers) | Lower right column on page 127, line 1, to lower left column on page 137, line 8 | Upper right column on page 36, line 12, to upper left column on page 37, line 19 | Page 4 line 30 to page 5 line 23, page 29 line 1 to page 45 line 25, page 45 lines 33 to 40, page 65 lines 2 to 21 |
| High Boiling Point and/or Low Boiling Point Organic Solvents | Lower left column on page 137, line 9, to upper right column on page 44, last line | Lower right column on page 35, line 14, to upper left column on page 36, line 4 from the bottom | Page 64, lines 1 to 51 |
| Methods for the Dispersion of Photographic-ally Useful Additives | Lower let column on page 144, line 1, to upper right column on page 146, line 7 | Lower right column on page 27, line 10, to upper left column on page 28, last line, and lower right column on page 35, line 12, to upper right column, page 36, line 7 | Page 63 line 51 to page 64 line 56 |
| Film Hardening Agents | Upper right column on page 146, line 8, to lower left column on page 155, line 4 | — | — |
| Developing Agent Precursors | Lower left column on page 155, line 5, to lower right column on page 155, line 2 | — | — |
| Development Inhibitor Releasing Compounds | Lower right column on page 155, lines 3 to 9 | — | — |
| Supports | Lower right column on page 155, line 19, to upper left column on page 156, line 14 | Upper right column on page 38, line 18 to upper left column on page 39, line 8 | Page 66, lines 29 to page 67, line 13 |
| Sensitive Material Layer Structure | Upper left column on page 156, line 15, to lower right column on page 156, line 14 | Upper right column on page 28, lines 1 to 15 | Page 45, lines 41 to 52 |
| Dyes | Lower right column on page 156, line 15, to lower right column on page 184, last line | Upper left column on page 38, line 12, to upper right column on page 38, line 7 | Page 66, lines 18 to 22 |
| Anti-color Mixing Agents | Upper left column on page 185, line 1, to lower right column on page 188, line 3 | Upper right column on page 36, lines 8 to 11 | Page 64 line 57 to page 65 line 1 |
| Gradation Control Agents | Lower right column on page 188, lines 4 to 8 | — | — |
| Anti-staining Agents | Lower right column on page 188, line 9, to lower right column on page 193, line 10 | Upper left column on page 37, last line, to lower right column, line 13 | Page 65 line 32 to page 66 line 17 |
| Surfactants | Lower left column on page 201, line 1, to upper right column on page 210, last line | Upper right column on page 18, line 1, to lower right column on page 24, last line, and lower left column on page 27, line 10 from the bottom, to lower right column, line 9 | — |
| Fluorine Containing Compounds (Anti-static agents, coating | Lower left column on page 210, line 1, to lower left column on page 222, line 5 | Upper left column on page 25, line 1, to lower right column on page 27, line 9 | — |

TABLE 4-continued

| Photographic Structural Element, etc. | JP-A-62-215272 | JP-A-2-33144 | EP0,355,660A2 |
|---|---|---|---|
| promoters, lubricants, and anti-static agents etc.) | | | |
| Binders (Hydrophilic colloids) | Lower left column on page 222, line 6, to upper left column on page 225, last line | Upper right column on page 38, lines 8 to 18 | Page 66, lines 23 to 28 |
| Thickeners | Upper right column on page 225, line 1, to upper right column on page 227, line 2 | — | — |
| Anti-static Agents | Upper right column on page 227, line 3, to upper left column on page 230, line 1 | — | — |
| Polymer Latexes | Upper left column on page 230, line 2, to page 239, last line | — | — |
| Matting Agents | Upper left column on page 240, line 1, to upper right column on page 240, last line | — | — |
| Photographic Processing Methods (Processing operations and additives etc.) | Upper right column on page 3, line 7, to upper right column on page 10, line 5 | Upper left column on page 39, line 4, to upper left column on page 42, last line | Page 67, line 14, to page 69, line 28 |

NOTES

The citations from JP-A-62-215272 also include the details amended in accordance with the procedural amendment dated 16th March 1987 which is appended to the end of the specification.

Furthermore, from among the color couplers mentioned above, the so-called short wave type yellow couplers disclosed in JP-A-63-231451, JP-A-63-123047, JP-A-63-241547, JP-A-1-173499, JP-A-1-213648 and JP-A-1-250944 may be used conjointly as yellow couplers with the couplers of formula (I).

Furthermore, the use of the 3-hydroxypyridine based cyan couplers disclosed in European Patent EPO,333,185A2 (from among these the couplers which have been made into two-equivalent couplers by including a chlorine leaving group in the four-equivalent coupler of coupler (42) which is cited as an actual example, and the couplers (6) and (9), are especially desirable), and the ring-like active methylene based cyan couplers disclosed in JP-A-64-32260 (from among these the couplers 3, 8 and 34 which are cited as actual examples are especially desirable) as well as the diphenylimidazole based cyan couplers disclosed in JP-A-2-33144 for the cyan couplers is desirable.

Furthermore, previously known yellow couplers can be used conjointly with the yellow couplers which have the structure indicated by formula (I) which are used in the present invention. Yellow couplers which can be used conjointly are indicated in Table 4(2). Furthermore, the cycloalkane type yellow couplers disclosed in European Patent EPO,447,969A1 can also be used conjointly.

The pyrazoloazole based magenta couplers and 5-pyrazole based magenta couplers such as those disclosed in the aforementioned literature cited in Table 4(2) can be used for the magenta couplers which are used in the present invention, but the use from among these of the pyrazolotriazole couplers which have a secondary or tertiary alkyl group bonded to the 2-, 3- or 6-position of the pyrazolotriazole ring as disclosed in JP-A-61-65245, the pyrazoloazole couplers which have a sulfonamido group within the molecule as disclosed in JP-A-61-65246, the pyrazoloazole based couplers which have an alkoxyphenylsulfonamido ballast group as disclosed in JP-A-61-147254, and the pyrazoloazole based couplers which have an alkoxy group or an aryloxy group in the 6-position as disclosed in European Patents 226,849A and 294,785A is preferred from the viewpoint of the hue, the stability of the colored image and the color forming properties for example.

The method disclosed in JP-A-H2-207250 is the preferred method of processing a color photosensitive material of the present invention.

The processing temperature of the color developer which can be used in the present invention is from 20° C. to 50° C., and preferably from 30° C. to 45° C. The preferred processing time is essentially within 25 seconds. A lower rate of replenishment is desirable, but a replenishment rate of 20 to 600 ml per 1 $m^2$ of photosensitive material is appropriate, and 50 to 300 ml is preferred. The rate of replenishment is more desirably 60 to 200 ml, and most desirably 60 to 150 ml, per 1 $m^2$ of photosensitive material.

In the present invention a development time of essentially within 25 seconds is preferred, and here the term "essentially within 25 seconds" indicates the interval from when the photosensitive material is introduced into the development tank until it is introduced into the next tank, and it includes the time while the photosensitive material is being carried through the air from the development tank into the next tank.

The preferred pH for the water washing process or stabilizing process is from 4 to 10, and most desirably from 5 to 8. The temperature can be set variously according to the use and characteristics of the photosensitive material, but it is generally from 30° C. to 45° C., and preferably from 35° C. to 42° C. The time can be set arbitrarily, but a shorter time is desirable from the viewpoint of reducing the processing time. The time is preferably from 10 to 45 seconds, and most desirably from 10 to 40 seconds. The rate of replenishment is preferably low from the viewpoint of the running costs, reducing the amount of effluent and the handling characteristics.

In practice, the preferred rate of replenishment is from 0.5 to 50 times, and preferably from 2 to 15 times, the amount of carry-over of the previous bath per unit area of photosensitive material. Alternatively it is not more than 300 ml, and preferably not more than 150 ml, per 1 $m^2$ of photosensitive material. Furthermore, replenishment can be carried out continuously or intermittently.

The liquid which has been used in the water washing and/or stabilizing process can be used in an earlier process. For example, the overflow of washing water which has been reduced by means of a multi-stage counter-flow system can be introduced into the preceding bleach-fix bath which can then be replenished using a concentrate and the amount of effluent can be reduced in this way.

The drying processes which can be used in the present invention are described below.

In the ultra-rapid processing of the present invention the drying time for completing the image is preferably from 20 seconds to 40 seconds. From the point of view of the photosensitive material, means of shortening the drying time include reducing the amount of hydrophilic binder such as gelatin and reducing the amount of carry-over of water in the film. Drying can also be speeded up by dealing with the water by means of a squeeze roller or cloth immediately after emergence from the water washing bath from the viewpoint of reducing the amount of water which is carried over. There are also of course means of improvement in terms of the dryer, and drying can be speeded up for example by raising the temperature or by strengthening the drying draught. Moreover, drying can also be speeded up by adjusting the angle at which the draught is directed onto the photosensitive material in a draught drier, and by removing the draught exhaust.

The total processing time from color development processing through to drying in the method of processing a color photosensitive material of the present invention is preferably not more than 120 seconds.

The invention is described in practical terms below by means of illustrative examples, but the invention is not limited by these examples.

EXAMPLE 1

A Multi-layer Color Printing Paper (101) of which the layer structure is indicated below was prepared by providing by coating following a corona discharge treatment on the surface of a paper support which had been laminated on both sides with polyethylene a gelatin under-layer which contained sodium dodecylbenzene sulfonate and then coating the various photographic structural layers. The coating liquids were prepared in the way indicated below.

Preparation of the First Layer Coating Liquid

The Yellow Coupler (ExY) (153.0 grams), 15.0 grams of Colored Image Stabilizer (Cpd-1), 7.5 grams of Colored Image Stabilizer (Cpd-2) and 16.0 grams of Colored Image Stabilizer (Cpd-3) were added to 25 grams of Solvent (Solv-1), 25 grams of Solvent (Solv-2) and 180 cc of ethyl acetate to form a solution which was then emulsified and dispersed in 1000 cc of a 10% aqueous gelatin solution which contained 60 cc of 10% sodium dodecylbenzenesulfonate and 10 grams of citric acid to prepare Emulsified Dispersion A. On the other hand, the Silver Chlorobromide Emulsion A (a 3:7 (Ag mol ratio) mixture of a cubic large grain emulsion of average grain size 0.88 μm and a cubic small grain emulsion of average grain size 0.70 μm; the variation coefficients of the grain size distributions were 0.08 and 0.10, and each emulsion had 0.3 mol % silver bromide included locally on parts of the surface of the grains, the remainder of the silver halide grains being comprised of silver chloride; hexachloroiridium(IV) acid, potassium salt, was included in an amount of 0.4 mg and potassium ferrocyanide was included in an amount of 1.8 mg within the grains and in the silver bromide local phase) was prepared. The blue sensitive Sensitizing Dyes A and B indicated below were added to this emulsion in amounts of $2.0\times10^{-4}$ mol and $2.5\times10^{-4}$ mol per mol of silver for the emulsion which had large grains and the emulsion which had small grains respectively, after which the emulsion was chemically sensitized optimally with the addition of sulfur sensitizer and gold sensitizer in the presence of the degradation products of nucleic acid. This Silver Chlorobromide Emulsion A was mixed with the aforementioned Emulsified Dispersion A to prepare the First Layer Coating Liquid of which the composition is indicated below.

The coating liquids for the second to the seventh layers were prepared using the same procedure as for the First Layer Coating Liquid. 1-Oxy-3,5-dichloro-s-triazine, sodium salt, was used as a gelatin hardening agent in each layer.

Furthermore, Cpd-14 and Cpd-15 were added to each layer in such a way that the total amounts were 25.0 mg/$m^2$ and 50.0 mg/$m^2$ respectively.

The silver chlorobromide emulsion of each photosensitive emulsion layer was adjusted in terms of size using the same method of preparation as for the aforementioned Silver Chlorobromide Emulsion A, and the spectrally sensitizing dyes indicated below were used for each layer.

Blue Sensitive Emulsion Layer

Sensitizing Dye A

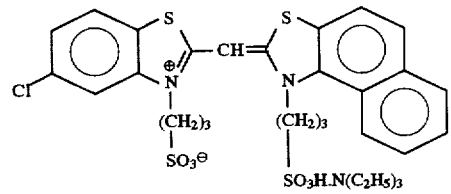

and

Blue Sensitizing Dye B

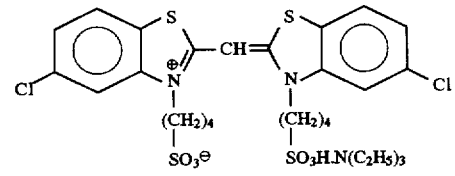

($2.0\times10^{-4}$ mol of each per mol of silver halide for the large size emulsion and $2.5\times10^{-4}$ mol of each per mol of silver halide for the small size emulsion)

Green Sensitive Layer

Sensitizing Dye C

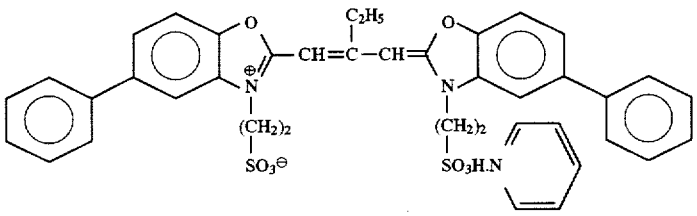

($4.0\times10^{-4}$ mol per mol of silver halide for the large size emulsion and $5.6\times10^{-4}$ mol per mol of silver halide for the small size emulsion)

Sensitizing Dye D

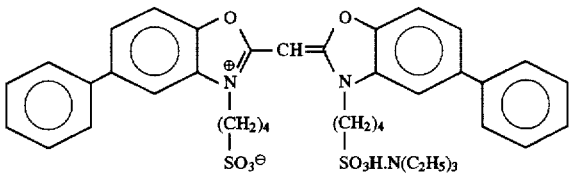

($7.0\times10^{-5}$ mol per mol of silver halide for the large size emulsion and $1.0\times10^{-4}$ mol per mol of silver halide for the small size emulsion)

Red Sensitive Layer

Sensitizing Dye E

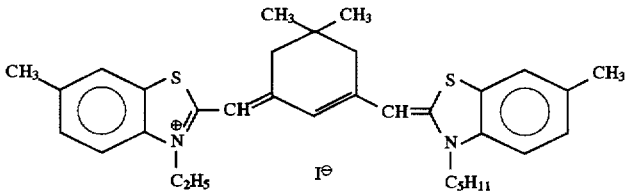

($0.9\times10^{-4}$ mol per mol of silver halide for the large size emulsion and $1.1\times10^{-4}$ mol per mol of silver halide for the small size emulsion)

Moreover, the compound indicated below was added in an amount of $2.6\times10^{-3}$ mol per mol of silver halide.

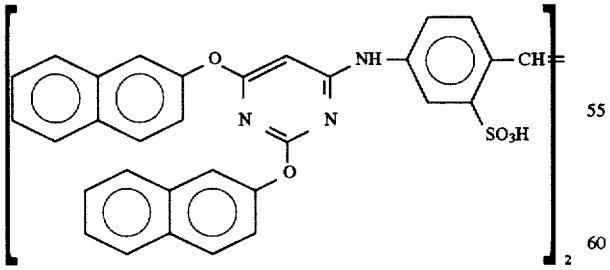

Furthermore, 1-(5-methylureidophenyl)-5-mercaptotetrazole was added to the blue, green and red sensitive emulsion layers in amounts, per mol of silver halide, of $2.5\times10^{-3}$ mol, $4.0\times010^{-3}$ mol and $2.5\times10^{-4}$ mol, respectively.

Furthermore, 4-hydroxy-6-methyl-1,3,3a,7-tetraazaindene was added to the blue and green sensitive emulsion layers in amounts, per mol of silver halide, of $1\times10^{-4}$ mol and $2\times10^{-4}$ mol respectively.

The dyes indicated below (coated weights in brackets) were added to the emulsion layers for anti-irradiation purposes.

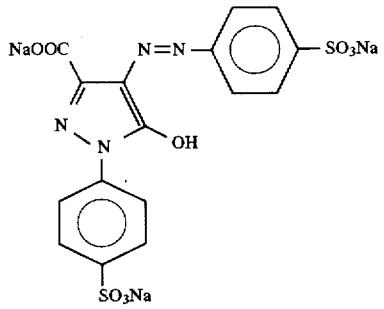

(10 mg/m²)

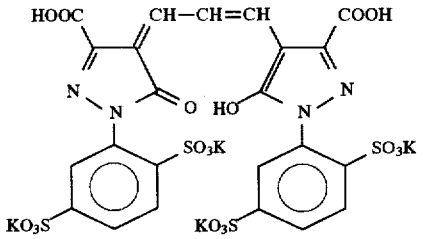

(10 mg/m²)

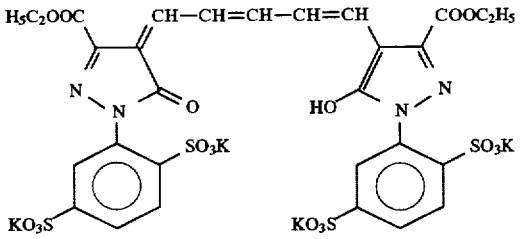

(40 mg/m²)

and

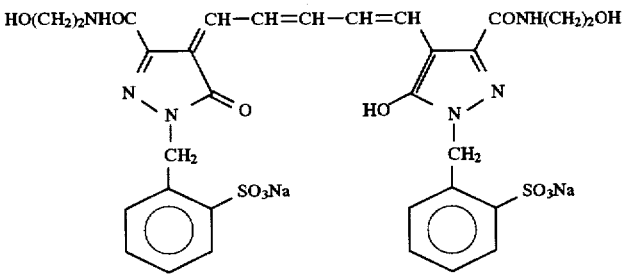

(20 mg/m²)

Layer Structure

The composition of each layer is indicated below. The numerical values indicate coated weights (g/m²). In the case of silver halide emulsions the coated weight is shown as the calculated coated weight of silver.

Support Polyethylene laminated paper [White pigment ($TiO_2$: content 14 percent by weight) and blue dye (ultramarine) were included in the polyethylene on the first layer side]

| First Layer (Blue Sensitive Emulsion Layer) | |
|---|---|
| The aforementioned Silver Chlorobromide Emulsion A | 0.27 |
| Gelatin | 1.22 |
| Yellow Coupler (ExY) | 0.79 |
| Colored Image Stabilizer (Cpd-1) | 0.08 |
| Colored Image Stabilizer (Cpd-2) | 0.04 |
| Colored Image Stabilized (Cpd-3) | 0.08 |
| Solvent (Solv-1) | 0.13 |
| Solvent (Solv-2) | 0.13 |

-continued

| | |
|---|---|
| Second Layer (Anti-color Mixing Layer) | |
| Gelatin | 0.90 |
| Anti-color Mixing Agent (Cpd-4) | 0.06 |
| Solvent (Solv-7) | 0.03 |
| Solvent (Solv-2) | 0.25 |
| Solvent (Solv-3) | 0.25 |
| Third Layer (Green Sensitive Emulsion Layer) | |
| Silver Chlorobromide Emulsion B (a 1:3 (silver mol ratio) mixture of a large grain cubic emulsion of average grain size 0.55 μm and a small grain emulsion of average grain size 0.39 μm; the variation coefficients of the grain size distributions were 0.10 and 0.08 respectively, and each emulsion had 0.8 mol % AgBr included locally on part of the grain surface. Moreover, 0.5 mg of hexachloroiridium(IV) acid, potassium salt, and 2 mg of potassium thiocyanate were included within the grains and in the silver bromide local phase.) | 0.13 |
| Gelatin | 1.28 |
| Magenta Coupler (ExM) | 0.16 |
| Colored Image Stabilizer (Cpd-5) | 0.15 |
| Colored Image Stabilizer (Cpd-2) | 0.03 |
| Colored Image Stabilizer (Cpd-6) | 0.01 |
| Colored Image Stabilizer (Cpd-7) | 0.01 |
| Colored Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Anti-color Mixing Layer) | |
| Gelatin | 0.70 |
| Anti-color Mixing Agent (Cpd-4) | 0.04 |
| Solvent (Solv-7) | 0.02 |
| Solvent (Solv-2) | 0.18 |
| Solvent (Solv-3) | 0.18 |
| Fifth Layer (Red Sensitive Emulsion Layer) | |
| Silver Chlorobromide Emulsion C (a 1:4 (silver mol ratio) mixture of a large grain cubic emulsion of average grain size 0.50 μm and a small grain cubic emulsion of average grain size 0.41 μm; the variation coefficients of the grain size distributions were 0.09 and 0.11 respectively, and each emulsion had 0.8 mol % AgBr included locally on part of the grain surface, the remainder being comprised of silver chloride. Moreover 0.5 mg of hexachloroiridium(IV), potassium salt, and 2.5 mg of potassium ferrocyanide were included within the grains and in the local silver bromide phase.) | 0.18 |
| Gelatin | 0.80 |
| Cyan Coupler (ExC) | 0.33 |
| Ultraviolet Absorber (UV-2) | 0.18 |
| Colored Image Stabilizer (Cpd-1) | 0.35 |
| Colored Image Stabilizer (Cpd-6) | 0.01 |
| Colored Image Stabilizer (Cpd-8) | 0.01 |
| Colored Image Stabilizer (Cpd-9) | 0.01 |
| Colored Image Stabilizer (Cpd-10) | 0.01 |
| Colored Image Stabilizer (Cpd-11) | 0.01 |
| Solvent (Solv-1) | 0.01 |
| Solvent (Solv-6) | 0.22 |
| Sixth Layer (Ultraviolet Absorbing Layer) | |
| Gelatin | 0.48 |
| Ultraviolet Absorber (UV-1) | 0.38 |
| Colored Image Stabilizer (Cpd-5) | 0.02 |
| Colored Image Stabilizer (Cpd-12) | 0.15 |
| Seventh Layer (Protective Layer) | |
| Gelatin | 1.10 |
| Acrylic modified poly(vinyl alcohol) (17% modification) | 0.05 |
| Liquid paraffin | 0.02 |
| Colored Image Stabilizer (Cpd-13) | 0.01 |

-continued
(ExY) Yellow Coupler
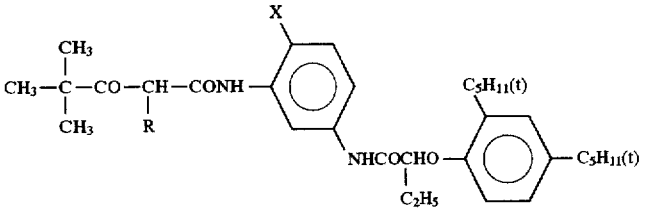
R =
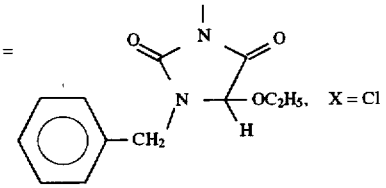
(ExM) Magenta Coupler
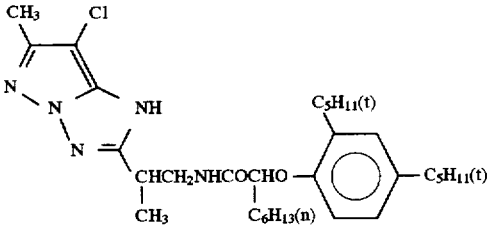
(ExC) Cyan Coupler
A 3:7 (mol ratio) mixture of
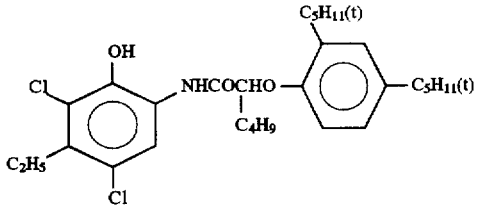
and
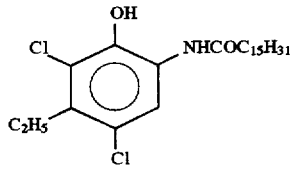
(Cpd-1) Colored Image Stabilizer
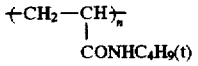
(Average molecular weight 60,000)

-continued
(Cpd-2) Colored Image Stabilizer
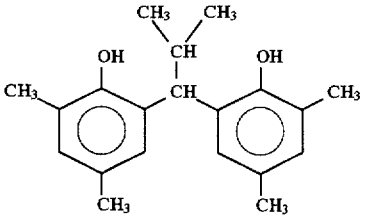
(Cpd-3) Colored Image Stabilizer
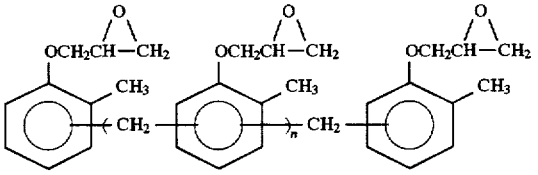
n = 7–8 (on average value)
(Cpd-4) Colored Image Stabilizer
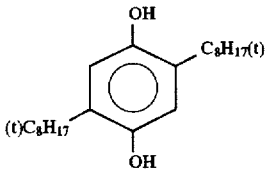
(Cpd-5) Colored Image Stabilizer
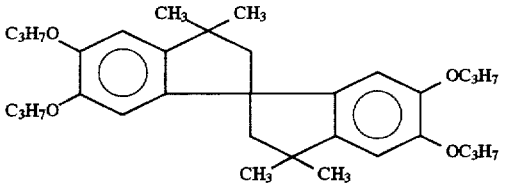
(Cpd-6) Colored Image Stabilizer
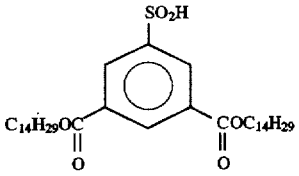
(Cpd-7) Colored Image Stabilizer
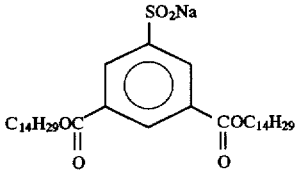

-continued
(Cpd-8) Colored Image Stabilizer
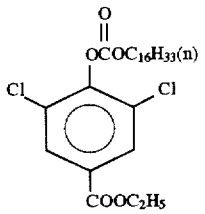
(Cpd-9) Colored Image Stabilizer
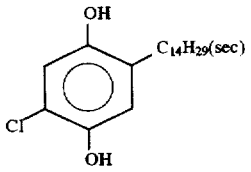
(Cpd-10) Colored Image Stabilizer
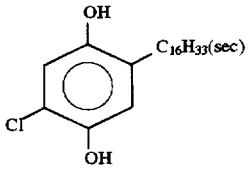
(Cpd-11) Colored Image Stabilizer
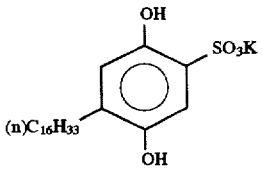
(Cpd-12) Colored Image Stabilizer
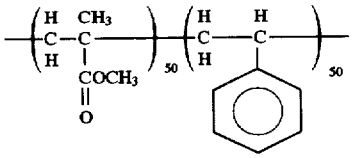
Average Molecular weight: About 60,000
(Cpd-13) Colored Image Stabilizer
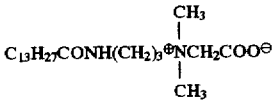

-continued
(Cpd-14) Fungicide
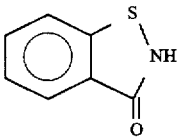
(Cpd-15) Fungicide
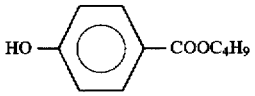
(UV-1) Ultraviolet Absorber
A 1:5:10:5 mixture (by weight) of (i), (ii), (iii) and (iv)
(i)
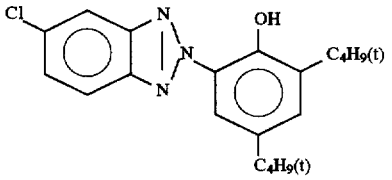
(ii)
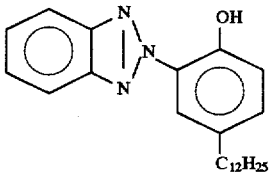
(iii)
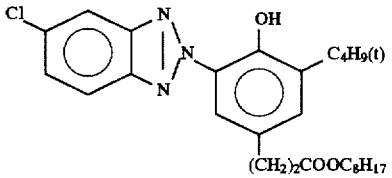
(iv)
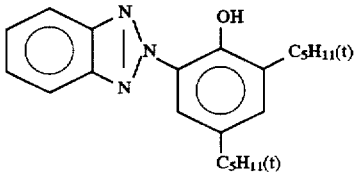
(UV-2) Ultraviolet Absorber
A 1:2:2 mixture (by weight) of (i), (ii) and (iii)

-continued
(i)
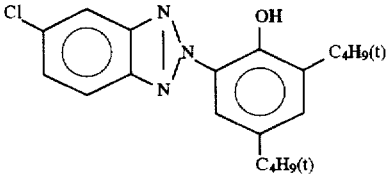
(ii)
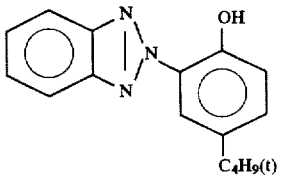
(iii)
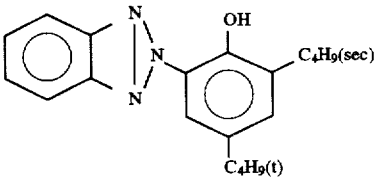
(Solv-1) Solvent
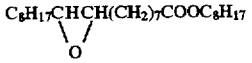
(Solv-2) Solvent
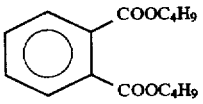
(Solv-3) Solvent
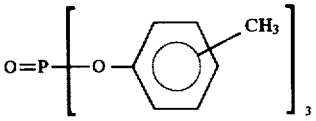
(Solv-4) Solvent
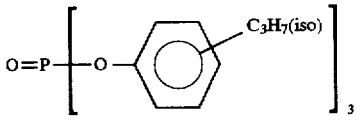
(Solv-5) Solvent
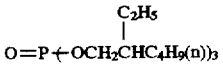

-continued (Solv-6) Solvent

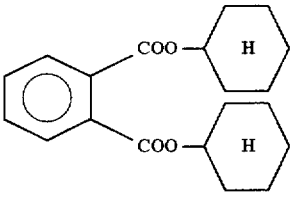

(Solv-7) Solvent

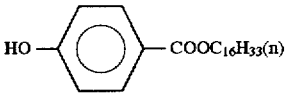

Photosensitive Materials 102 to 108 which had a similar structure to Photosensitive Material 101 were prepared by changing in the ways indicated in Table A the type and coated weight of yellow coupler and the coated silver weight in the first layer (blue sensitive emulsion layer) of Photosensitive Material 101.

TABLE A

| Sensitive Material | Yellow Coupler Used in the First Layer: Coupler | Amount Used ($g/m^2$) | Coated Weight of Silver in the First Layer ($g/m^2$) | Remarks |
|---|---|---|---|---|
| 101 | ExY | 0.79 | 0.27 | Comparative Example |
| 102 | Y-1 | 0.79 | 0.27 | Comparative Example |
| 103 | No. 1 | 0.55 | 0.19 | This Invention |
| 104 | No. 2 | 0.55 | 0.19 | This Invention |
| 105 | No. 16 | 0.55 | 0.19 | This Invention |
| 106 | No. 29 | 0.55 | 0.19 | This Invention |
| 107 | No. 8 | 0.55 | 0.19 | This Invention |
| 108 | No. 37 | 0.55 | 0.19 | This Invention |

Comparative Yellow Coupler (Y-1)

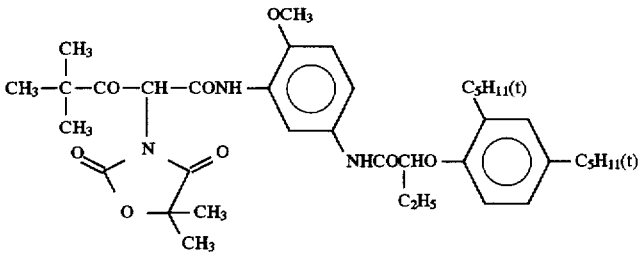

The sensitive materials so obtained were to two types of exposure as indicated below.

(1) Scanning Exposure

A YAG solid laser (oscillating wavelength 946 nm) with a GaAlAs semiconductor laser (oscillating wavelength 808.5 nm) as exciting light source which was wavelength converted to emit light of wavelength 473 nm by means of a $KNbO_3$ SHG crystal, a $YVO_4$ solid laser (oscillating wavelength 1064 nm) with a GaAlAs semiconductor laser (oscillating wavelength 808.7 nm) as exciting light source which was wavelength converted to emit light of wavelength 532 nm by means of a KTP SHG crystal, and an AlGaInP semiconductor laser (oscillating wavelength about 670 nm, made by Toshiba, Type No. TOLD9211) were used for the light sources. The apparatus was set up in such a way that the laser light was made to scan by means of rotating polygonal bodies and it was possible to make a sequential scanning exposure on a color printing paper which was being moved in the direction perpendicular to the scanning direction. Using this apparatus, the relationship D-log E of the density (D) of the photosensitive material and the exposure (E) was obtained by varying the level of exposure. At this time the laser light of the three wavelengths was modulated using external modulators to control the exposure levels. The scanning exposure was carried out at 400 dpi, and the average exposure time per picture element was about $5\times10^{-8}$ seconds. Peltier elements were used to suppress the fluctuation in the exposure levels due to the temperature and the temperature was held more or less constant.

(2) Surface Exposure

Monochromatic light was obtained using 470 nm, 535 nm and 670 nm interference filters and graded exposures were made through a graded wedge for sensitometric purposes using a sensitometer (made by Fuji Photo Film Co., Ltd., FWH type, light source color temperature 3200° K.). The exposures at this time were made at a level of 2500 CMS with an exposure time of 1 second.

The exposed samples were color processed via the processing operations indicated below using a paper processor. At this time, the processing was carried out under two sets of conditions with the pH of the development processing liquid being set to (a) 10.30 and (b) 10.00.

The reciprocals of the logarithms of the exposures required to provide a blue sensitive layer yellow density of 1.0 in the samples processed under conditions (a) and (b) were obtained and the photographic speeds Sc(1–(a)) {the photographic speed of the sample subjected to exposure (1) processed under conditions (a)}, Sc(1–(b)), {the photographic speed of the sample subjected to exposure (1) processed under conditions (b)}, Sc(2–(a)) {the photographic speed of the sample subjected to exposure (2) processed under conditions (a)}, and Sc(2–(b) {the photographic speed of the sample subjected to exposure (2) processed under conditions (b)} were obtained. The differences in photographic speed:

ΔS1 [Sc(1–(b))–Sc(1–(a))],

ΔS2 [Sc(2–(b))–Sc(2–(a))], provided a measure of the change in photographic speed of the blue sensitive layer due to fluctuations in the pH of the processing bath when carrying out a scanning exposure or a surface exposure respectively.

| Processing Operation | Temperature | Time | Tank Capacity |
|---|---|---|---|
| Color development | 35° C. | 45 sec. | 17 liters |
| Bleach-fix | 30–35° C. | 45 sec. | 17 liters |
| Rinse (1) | 30–35° C. | 20 sec. | 10 liters |
| Rinse (2) | 30–35° C. | 20 sec. | 10 liters |
| Rinse (3) | 30–35° C. | 20 sec. | 10 liters |
| Drying | 70–80° C. | 60 sec. | |

The composition of each processing bath was as indicated below.

| | Tank Liquid |
|---|---|
| Color Developer | |
| Water | 800 ml |
| Ethylenediamine-N,N,N',N'-tetra-methylenephosphonic acid | 1.5 grams |
| Potassium bromide | 0.015 gram |
| Triethanolamine | 8.0 grams |
| Sodium chloride | 1.4 grams |
| Potassium carbonate | 25 grams |
| N-Ethyl-N-(β-methanesulfonamidoethyl)-3-methyl-4-aminoaniline sulfate | 5.0 grams |
| N,N-Bis(carboxymethyl)hydrazine | 4.0 grams |
| N,N-Di-(sulfoethyl)hydroxylamine.1Na | 4.0 grams |
| Fluorescent whitener (WHITEX 4B, made by Sumitomo Kagaku) | 1.0 gram |
| Water | to make up to 1000 ml |
| pH (25° C.) | (a) 10.30, (b) 10.00 |
| Bleach-Fixer | |
| Water | 400 ml |
| Ammonium thiosulfate (700 g/l) | 100 ml |
| Sodium sulfite | 17 grams |
| Ethylenediamine tetra-acetic acid, iron(III) ammonium salt | 55 grams |
| Ethylene diamine tetra-acetic acid, di-sodium salt | 5 grams |
| Ammonium bromide | 40 grams |
| Water | to make up to 1000 ml |
| pH (25° C.) | 6.0 |

TABLE B

| Sensitive Material | Change in Photographic Speed of the Yellow Layer due to Change in Developer pH: ΔS1 (Scanning Exposure) | ΔS2 (surface Exposure) | Remarks |
|---|---|---|---|
| 101 | –0.06 | –0.02 | Comparative Example |
| 102 | –0.05 | –0.01 | Comparative Example |
| 103 | –0.02 | –0.01 | This Invention |
| 104 | –0.02 | –0.01 | This Invention |
| 105 | –0.01 | –0.01 | This Invention |
| 106 | –0.02 | –0.01 | This Invention |
| 107 | –0.03 | –0.02 | This Invention |
| 108 | –0.02 | –0.01 | This Invention |

ΔS1 [Sc(1 – (b)) – Sc(1 – (a))]
ΔS2 [Sc(2 – (b)) – Sc(2 – (a))]

It is clear from the results in Table B that when a yellow coupler of the present invention is used in the blue sensitive layer the variation in photographic speed of the blue sensitive layer to fluctuations in the processing bath is small. Moreover, the effect is more pronounced with a scanning exposure where there is a short exposure at a high brightness level.

EXAMPLE 2

Preparation of Emulsion a

Sodium chloride (3.3 grams) and 24 ml of 1N sulfuric acid were added to a 3% aqueous solution of lime treated gelatin and 3.2 ml of a 2% aqueous solution of N,N'-dimethylimidazolin-2-thione were added. An aqueous solution which contained 0.7 mol of silver nitrate and an aqueous solution which contained 0.7 mol of sodium chloride and 15 μg of rhodium trichloride were added to, and mixed with, this aqueous solution at 58° C. while agitating the mixture vigorously. Next, an aqueous solution which contained 0.29 mol of silver nitrate and an aqueous solution which contained 0.29 mol of sodium chloride and 4.2 mg of potassium ferrocyanide were added to, and mixed with, the mixture at 58° C. while agitating the mixture vigorously. Five minutes after the addition of the aqueous silver nitrate solution and the aqueous alkali halide solution had been completed, a copolymer of isobutene maleic acid mono-sodium salt was added, precipitation and washing were carried out and the emulsion was de-salted. Moreover, 90.0 grams of lime treated gelatin were added and, after adjusting the pH and pAg values of the emulsion to 6.5 and 7.0 respectively, $2\times10^{-4}$ mol of (Dye-F) was added at 50° C. and, after 15 minutes had elapsed, 0.01 mol equivalent with respect to the silver nitrate of fine silver bromide grains (average grain size 0.05 μm) and an aqueous solution which contained 0.8 mg of hexachloroiridium(IV) acid, potassium salt, were added and mixed with vigorous agitation. Moreover, $1\times10^{-5}$ mol/mol·Ag of sulfur sensitizer, $1\times10^{-5}$ mol/mol·Ag of chloroauric acid and 0.2 g/mol·Ag of the degradation product of nucleic acid were added and optimal chemical sensitization was carried out.

The form, size and the grain size distribution of the silver chlorobromide grains a so obtained were obtained from electron micrographs. These silver halide grains were all cubic grains, the grain size was 0.51 μm and the variation coefficient was 0.08. The grain size was represented by the average value of the diameters of the circles which had the same area as the projected areas of the grains, and the value obtained by dividing the standard deviation of the grain size by the average grain size was used for the variation coefficient.

of which the halogen composition is uniform gives a single peak whereas the diffraction line from a crystal which has a local phase which has a different composition gives a complex peak corresponding to the respective compositions. It is possible to determine the halogen composition of the silver halide from which the crystals are made by calculating the lattice constants from the measured diffraction angles of the peaks. The results of the measurements made with Silver Chlorobromide Emulsion a provided in addition to the main peak for 100% silver chloride a broad diffraction pattern centered on 70% silver chloride (30% silver bromide) and extending to the 60% silver chloride (40% silver bromide) side.

Formation of Emulsions b and c

Emulsion b was obtained in the same way as Emulsion a except that $4\times10^{-5}$ mol of (Dye-G) was used instead of the (Dye-F) used in Emulsion a, and Emulsion c was obtained in the same way as Emulsion a except that $2\times10^{-5}$ mol of (Dye-H) was used instead of (Dye-F).

A 1:1 mixture (mol ratio) of:

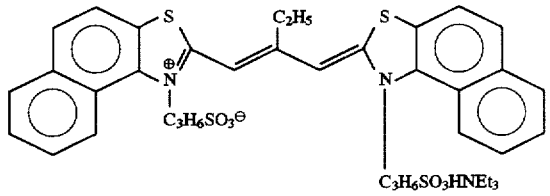

(Dye F)

and

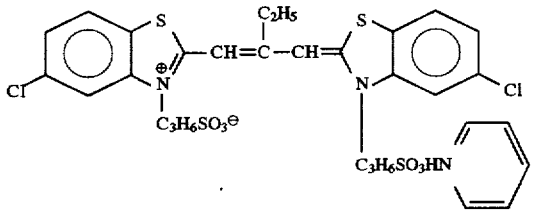

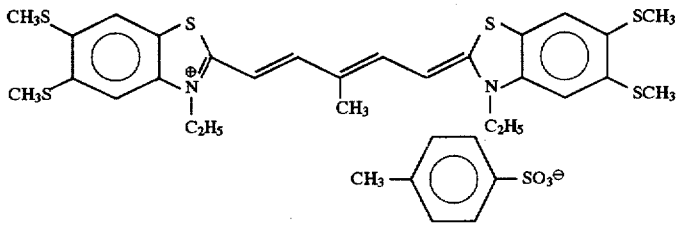

(Dye-G)

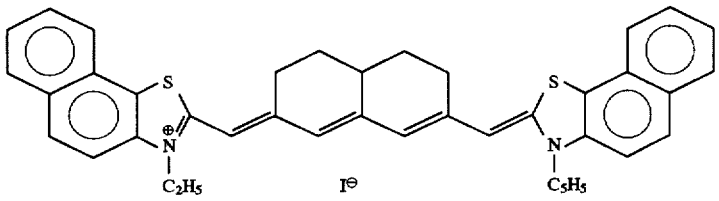

(Dye-H)

Next, the halogen composition of the emulsion grains was determined by measuring the X-ray diffraction from the silver halide crystals. The diffraction angle from the (200) plane was measured in detail using a monochromatic $Cu_{k\alpha}$ line for the X-ray source. The diffraction line from a crystal 1-(5-Methylureidophenyl)-5-mercaptotetrazole was added to Emulsions a, b and c in an amount of $5.0\times10^{-4}$ mol per mol of silver halide.

Moreover, (Cpd-16) and (Cpd-17) were added to Emulsions b and c in amounts of $3\times10^{-3}$ mol and $1\times10^{-3}$ mol respectively, per mol of silver halide.

(Cpd-16)

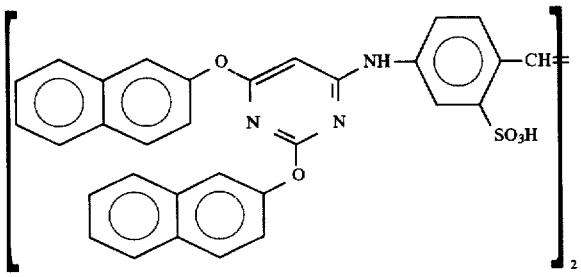

(Cpd-17)

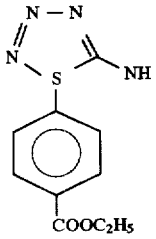

Preparation of Photosensitive Material 201

Photosensitive Material 201 was prepared in the same way as Photosensitive Material 101 shown in Example 1 except that Emulsion a was used in the first layer, Emulsion b was used in the third layer and Emulsion c was used in the fifth layer instead of the Emulsions A, B and C which were used in the first, third and fifth layers of Photosensitive Material 101, and the dyes indicated below were used instead of the anti-irradiation dyes used in Example 1.

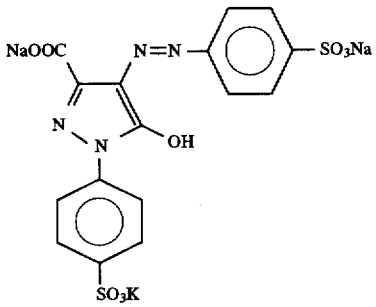

(10 mg/m²)

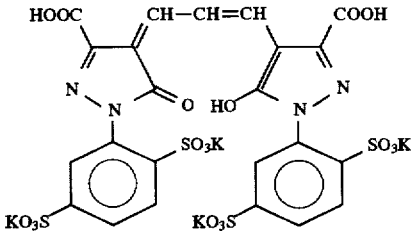

(10 mg/m²)

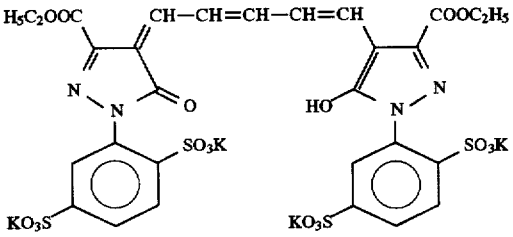

(40 mg/m²)

and

-continued

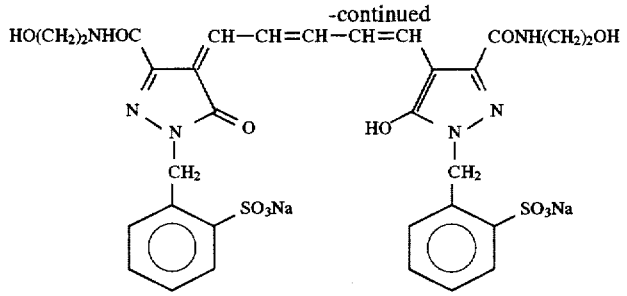

(20 mg/m²)

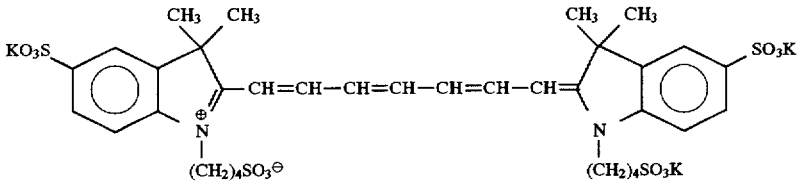

(10 mg/m²)

and

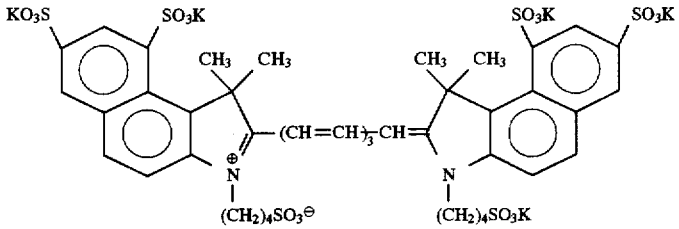

(5 mg/m²)

and

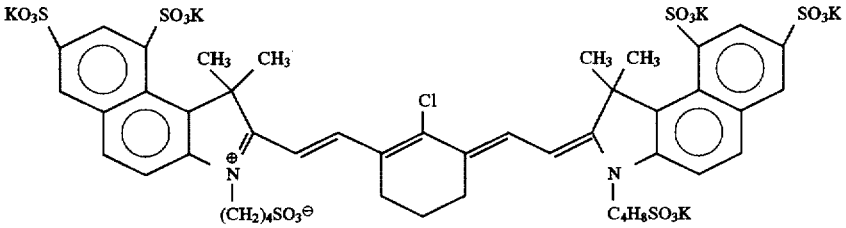

(5 mg/m²)

The photosensitive material was constructed with a red sensitive yellow color forming layer (first layer) which had a spectral sensitization peak at about 670 nm, a red sensitive magenta color forming layer (third layer) which had a spectral sensitization peak at about 730 nm and an infrared sensitive cyan color forming layer (fifth layer) which had a spectral sensitization peak at about 830 nm.

Photosensitive Materials 202 to 208 were prepared in the same way as Photosensitive Material 201 except that the type and coated weight of the yellow coupler, and the coated weight of silver, in the first layer, the red sensitive yellow color forming photosensitive layer, of the Photosensitive Material 201 were modified in the way shown in Table C.

TABLE C

| Sensitive Material | Yellow Coupler Used in the First Layer: Coupler | Amount Used (g/m²) | Weight of Coated Silver in the First Layer (g/m²) | Remarks |
|---|---|---|---|---|
| 201 | ExY | 0.79 | 0.27 | Comparative Example |
| 202 | Y-1 | 0.79 | 0.27 | Comparative Example |
| 203 | No. 1 | 0.55 | 0.19 | This Invention |
| 204 | No. 2 | 0.55 | 0.19 | This Invention |
| 205 | No. 16 | 0.55 | 0.19 | This Invention |
| 206 | No. 29 | 0.55 | 0.19 | This Invention |
| 207 | No. 8 | 0.55 | 0.19 | This Invention |
| 208 | No. 37 | 0.55 | 0.19 | This Invention |

Note: the structures of couplers ExY and Y-1 are given in Example 1.

The photosensitive materials so obtained were subjected to two types of exposure as indicated below.

(1) Scanning Exposure

An AlGaInP semiconductor laser (oscillating wavelength about 670 nm, made by Toshiba, Type No. TOLD9211), a GaAlAs semiconductor laser (oscillating wavelength about 750 nm made by Sharp, Type No. LTO30MDO), and a GaAlAs semiconductor laser (oscillating wavelength about 830 nm, made by Sharp, Type No. LTO15MDO) were used. The apparatus was set up in such a way that the laser light was made to scan by means of rotating polygonal bodies and it was possible to make a sequential scanning exposure on a color printing paper which was being moved in the direction perpendicular to the scanning direction. Using this apparatus, the relationship D-log E of the density (D) of the photosensitive material and the exposure (E) was obtained by varying the level of exposure. The quantity of laser light was modulated and the exposure was controlled by means of a combination of a pulse width modulation system which modulated the quantity of light by varying the period of time for which electrical power was supplied to the semiconductor laser and an intensity modulating system with which the quantity of light was modulated by changing the amount of power which was supplied. The scanning exposure was carried out at 400 dpi, and the average exposure time per picture element was about $10^{-7}$ seconds. Peltier elements were used to suppress the fluctuations in the exposure levels due to the temperature and the temperature was held more or less constant.

(2) Surface Exposure

Monochromatic light was obtained using 670 nm, 750 nm and 830 nm interference filters and graded exposures were made through a graded wedge for sensitometric purposes using a sensitometer (made by Fuji Photographic Film Co., FWH type, light source color temperature 3200° K.). The exposures at this time were made at a level of 25000 CMS with an exposure time of 1 second.

The exposed samples were color processed via the same processing steps and using the same processing liquids as indicated in Example 1. At this time the processing was carried out under two sets of conditions with the pH of the development processing liquid being set to (a) 10.30 and (b) 10.00.

The reciprocals of the logarithms of the exposures required to provide a red sensitive layer yellow density of 1.0 in the samples processed under conditions (a) and (b) were obtained and the photographic speeds Sc(1–(a)), Sc(1–(b)), Sc(2–(a)), Sc(2–(b)) were obtained. Sc(1–(a)), Sc(1–(b)), Sc(2–(a)) and Sc(2–(b)) have the same meaning in this Example 2 as in Example 1. The differences in photographic speed:

ΔS1 [Sc(1–(b))–Sc(1–(a))],

ΔS2 [Sc(2–(b))–Sc(2–(a))], provided a measure of the change in photographic speed of the red sensitive layer due to fluctuations in the pH of the processing bath when carrying out a scanning exposure or a surface exposure respectively.

The results of the samples obtained are shown in Table D.

Table D

| Sensitive Material | Change in Photographic Speed of the Yellow Layer due to Change in Developer pH: ΔS1 (Scanning Exposure) | ΔS2 (surface Exposure) | Remarks |
|---|---|---|---|
| 201 | −0.07 | −0.03 | Comparative Example |
| 202 | −0.06 | −0.02 | Comparative Example |
| 203 | −0.03 | −0.02 | This Invention |

Table D-continued

| Sensitive Material | Change in Photographic Speed of the Yellow Layer due to Change in Developer pH: ΔS1 (Scanning Exposure) | ΔS2 (surface Exposure) | Remarks |
|---|---|---|---|
| 204 | −0.04 | −0.02 | This Invention |
| 205 | −0.02 | −0.01 | This Invention |
| 206 | −0.03 | −0.02 | This Invention |
| 207 | −0.02 | −0.02 | This Invention |
| 208 | −0.03 | −0.02 | This Invention |

ΔS1 [Sc(1 – (b)) – Sc(1 – (a))]
ΔS2 [Sc(2 –(b)) – Sc(2 – (a))]

It is clear from the results obtained that the variation photographic speed of the red sensitive layer due to fluctuations in the processing liquids is small when a yellow coupler of the present invention is used in the red sensitive layer. Moreover, the effect is more pronounced with a scanning exposure where the exposure is short and at a high level of brightness.

EXAMPLE 3

Photosensitive Material 301 of which the layer structure is indicated below was prepared.

Preparation of Sensitive Material 301

A multi-layer color printing paper of which the layer structure is indicated below was prepared by providing by coating following a corona discharge treatment on the surface of a paper support which had been laminated on both sides with polyethylene a gelatin under-layer which contained sodium dodecylbenzene sulfonate and then coating the various photographic structural layers. The coating liquids were prepared in the way indicated below.

Preparation of the First Layer Coating Liquid

Ethyl acetate (27.2 cc) and 4.1 grams each of the Solvents (Solv-33) and (Solv-37) were added to 19.1 grams of the Yellow Coupler (EX3Y), 4.4 grams of Colored Image Stabilizer (Cpd-31) and 0.7 grams of Colored Image Stabilizer (Cpd-37) to form a solution which was then emulsified and dispersed in 185 cc of a 10% aqueous gelatin solution which contained 8 cc of 10% sodium dodecylbenzenesulfonate to prepare an emulsified dispersion. On the other hand, the aforementioned emulsified dispersion was mixed with and dissolved in the Silver Chlorobromide Emulsion A used in Example 1 to prepare the first layer coating liquid of which the composition is indicated below.

The coating liquids for the second to the seventh layers were prepared using the same procedure as for the first layer coating liquid. Moreover, 1-oxy-3,5-dichloro-s-triazine, sodium salt, was used as a gelatin hardening agent for each layer.

Furthermore, Cpd-310 and Cpd-311 were added to each layer in such a way that the total amounts were 25.0 mg/m$^2$ and 50.0 mg/m$^2$ respectively.

The Sensitizing Dyes A and B, the Sensitizing Dyes C and D, and the Sensitizing dye E were used as the sensitizing dyes for each layer. The structures of these dyes are shown in Example 1.

Furthermore, 1-(5-methylureidophenyl)-5-mercaptotetrazole was added to the blue, green and red sensitive emulsion layers in amounts, per mol of silver halide, of $8.5\times10^{-5}$ mol, $7.7\times10^{-4}$ mol and $2.5\times10^{-4}$ mol respectively.

Furthermore, 4-hydroxy-6-methyl-1,3,3a,7-tetraazaindene was added to the blue and green sensitive emulsion layers in amounts, per mol of silver halide, of $1\times10^{-4}$ mol and $2\times10^{-4}$ mol respectively.

Furthermore, the dyes used in each layer in Example 1 were added for anti-irradiation purposes.

Layer Structure

The composition of each layer is indicated below. The numerical values indicate coated weights ($g/m^2$). In the case of silver halide emulsions the coated weight is shown as the calculated coated weight of silver.

Support

Polyethylene laminated paper [White pigment ($TiO_2$; content 14 percent by weight) and blue dye (ultramarine) were included in the polyethylene on the first layer side]

| | |
|---|---|
| First Layer (Blue Sensitive Layer) | |
| The Silver Chlorobromide Emulsion A used in Example 1 | 0.30 |
| Gelatin | 1.22 |
| Yellow Coupler (Ex3Y) | 0.82 |
| Colored Image Stabilizer (Cpd-31) | 0.19 |
| Solvent (Solv-33) | 0.18 |
| Solvent (Solv-37) | 0.18 |
| Colored Image Stabilizer (Cpd-37) | 0.06 |
| Second Layer (Anti-color Mixing Layer) | |
| Gelatin | 0.64 |
| Anti-color Mixing Agent (Cpd-35) | 0.10 |
| Solvent (Solv-31) | 0.16 |
| Solvent (Solv-34) | 0.08 |
| Third Layer (Green Sensitive Layer) | |
| The Silver Chlorobromide Emulsion B used in Example 1 | 0.12 |
| Gelatin | 1.28 |
| Magenta Coupler (Ex3M) | 0.23 |
| Colored Image Stabilizer (Cpd-32) | 0.03 |
| Colored Image Stabilizer (Cpd-33) | 0.16 |
| Colored Image Stabilizer (Cpd-34) | 0.02 |
| Colored Image Stabilizer (Cpd-39) | 0.02 |
| Solvent (Solv-32) | 0.40 |
| Fourth Layer (Ultraviolet Absorbing Layer) | |
| Gelatin | 1.41 |
| Ultraviolet Absorber (UV-31) | 0.47 |
| Anti-color Mixing Agent (Cpd-35) | 0.05 |
| Solvent (Solv-35) | 0.24 |
| Fifth Layer (Red Sensitive Layer) | |
| The Silver Chlorobromide Emulsion C used in Example 1 | 0.23 |
| Gelatin | 1.04 |
| Cyan Coupler (Ex3C) | 0.32 |
| Colored Image Stabilizer (Cpd-32) | 0.03 |
| Colored Image Stabilizer (Cpd-34) | 0.02 |
| Colored Image Stabilizer (Cpd-36) | 0.18 |
| Colored Image Stabilizer (Cpd-37) | 0.40 |
| Colored Image Stabilizer (Cpd-38) | 0.05 |
| Solvent (Solv-36) | 0.14 |
| Sixth Layer (Ultraviolet Absorbing Layer) | |
| Gelatin | 0.48 |
| Ultraviolet Absorber (UV-31) | 0.16 |
| Anti-color Mixing Agent (Cpd-35) | 0.02 |
| Solvent (Solv-35) | 0.08 |
| Seventh Layer (Protective Layer) | |
| Gelatin | 0.10 |
| Acrylic modified poly(vinyl alcohol) (17% modification) | 0.17 |
| Liquid paraffin | 0.03 |

-continued
Ex3Y)
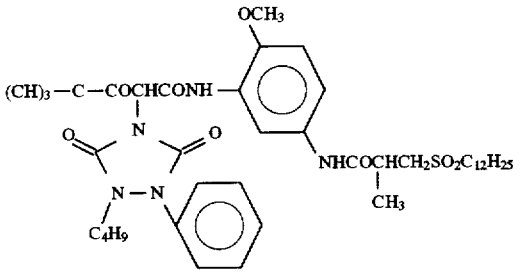
(Ex3M)
A 1:1 mixture (by weight) of:
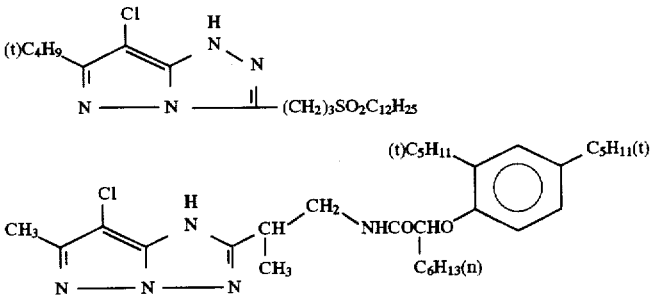
(Ex3C)
A 7:2 mixture (mol ratio) of:
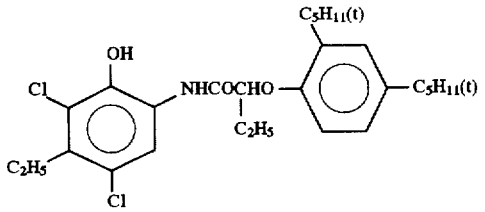
and
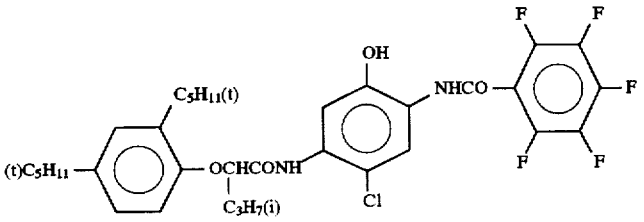
(Cpd-31) Colored Image Stabilizer
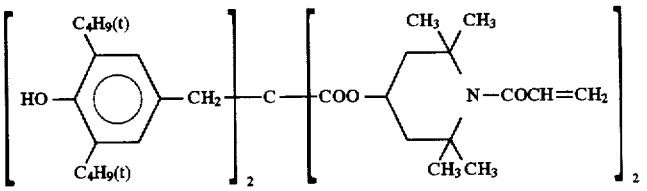

-continued
(Cpd-32) Colored Image Stabilizer
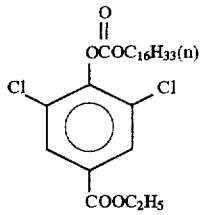
(Cpd-33) Colored Image Stabilizer
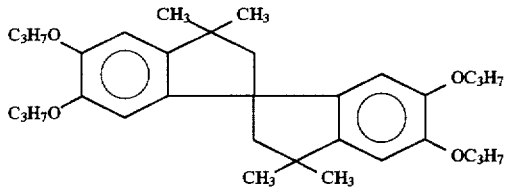
(Cpd-34) Colored Image Stabilizer
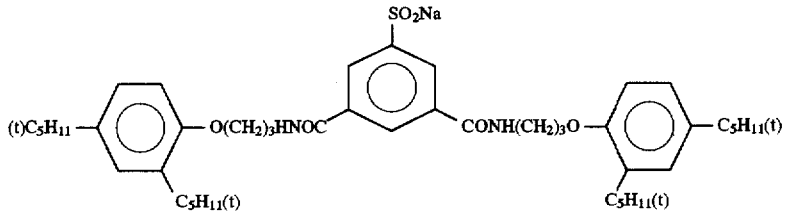
(Cpd-35) Colored Image Stabilizer
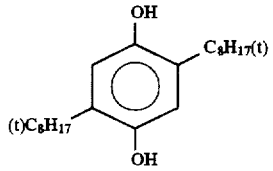
(Cpd-36) Colored Image Stabilizer
A 2:4:4 mixture (by weight) of:
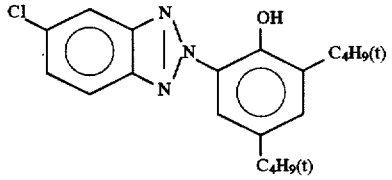
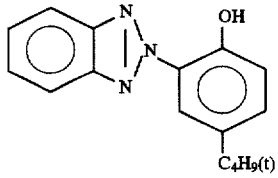

-continued
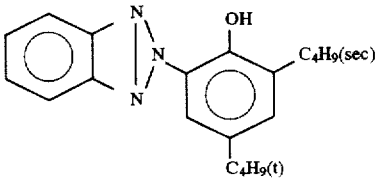
(Cpd-37) Colored Image Stabilizer
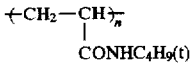
(Average Molecular Weight 60,000)
(Cpd-38) Colored Image Stabilizer
A 1:1 mixture (by weight) of:
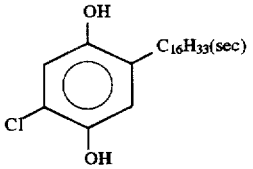
and
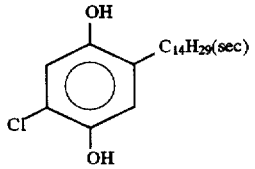
(Cpd-39) Colored Image Stabilizer
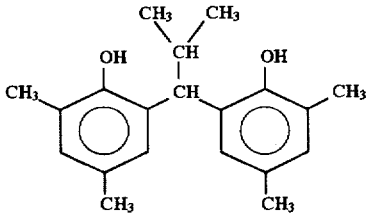
(Cpd-310) Fungicide
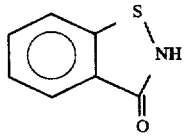
(Cpd-311) Fungicide
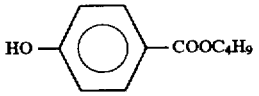

-continued
(UV-31) Ultraviolet Absorber
A 4:2:4 mixture (by weight) of:
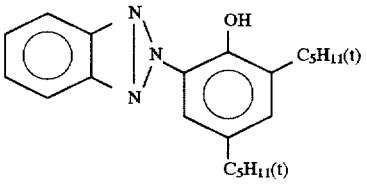
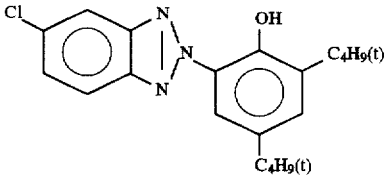
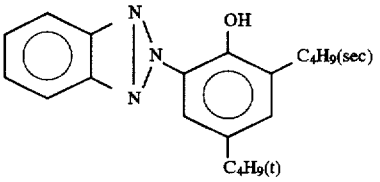
(Solv-31) Solvent
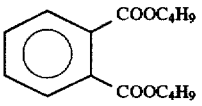
(Solv-32) Solvent
A 1:1 mixture (by volume) of:
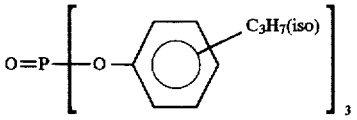
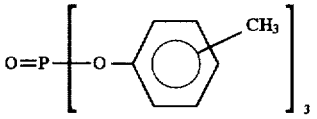
(Solv-33) Solvent
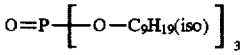
(Solv-34) Solvent
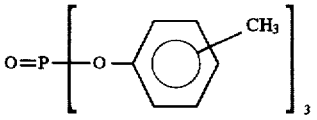

-continued (Solv-35) Solvent $$\begin{array}{l} COOC_8H_{17} \\ | \\ (CH_2)_8 \\ | \\ COOC_8H_{17} \end{array}$$

(Solv-36) Solvent

A 80:20 mixture (by volume) of:

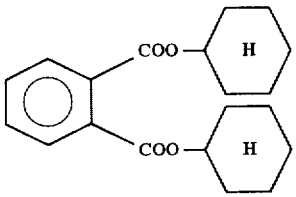

and $$C_8H_{17}\underset{\underset{O}{\diagdown\ \diagup}}{CHCH}(CH_2)_7COOC_8H_{17}$$

(Solv-37) Solvent $$C_8H_{17}\underset{\underset{O}{\diagdown\ \diagup}}{CHCH}(CH_2)_7COOC_8H_{17}$$

Photosensitive Materials 302 to 307 which had a similar structure to Photosensitive Material 301 were prepared in the same way except that the type and amount of yellow coupler and the amount of coated silver in the first layer (blue sensitive layer) of Photosensitive Material 301 were modified in the ways indicated in Table E.

TABLE E

| Sensitive Material | Yellow Coupler Used in the First Layer: Coupler | Yellow Coupler Used in the First Layer: Amount Used ($g/m^2$) | Weight of Coated Silver in the First Layer ($g/m^2$) | Remarks |
|---|---|---|---|---|
| 301 | Ex3Y | 0.82 | 0.30 | Comparative Example |
| 302 | ExY | 0.82 | 0.30 | Comparative Example |
| 303 | No. 1 | 0.57 | 0.21 | This Invention |
| 304 | No. 2 | 0.57 | 0.21 | This Invention |
| 305 | No. 16 | 0.57 | 0.21 | This Invention |
| 306 | No. 25 | 0.57 | 0.21 | This Invention |
| 307 | No. 29 | 0.57 | 0.21 | This Invention |

Note: The structure of coupler ExY is shown in Example 1.

The photosensitive materials were exposed and in the same way as described in Example 1 and were evaluated in the same way as before. The results are shown in Table F.

TABLE F

| Sensitive Material | Change in Photographic Speed of the Yellow Layer due to Change in Developer pH: ΔS1 (Scanning Exposure) | ΔS2 (surface Exposure) | Remarks |
|---|---|---|---|
| 301 | −0.05 | −0.02 | Comparative Example |
| 302 | −0.07 | −0.03 | Comparative Example |
| 303 | −0.02 | −0.01 | This Invention |
| 304 | −0.01 | −0.02 | This Invention |
| 305 | −0.02 | −0.02 | This Invention |
| 306 | −0.02 | −0.02 | This Invention |
| 307 | −0.03 | −0.02 | This Invention |

ΔS1 [Sc(1 − (b)) − Sc(1 − (a))]
ΔS2 [Sc(2 − (b)) − Sc(2 − (a))]

It is clear from the results obtained that, as in Example 1, the change in photographic speed of the blue sensitive layer due to a change in the pH of the processing liquid is small when a yellow coupler of the present invention is used in the blue sensitive layer. Moreover, the effect is more pronounced with a scanning exposure using short exposures at a high level of brightness.

EXAMPLE 4

The Photosensitive Materials 101 to 108, 201 to 208 and 301 to 307 prepared in Examples 1, 2 and 3 were exposed in the ways described in the respective examples and then they were processed in a paper processor using a freshly prepared color developer via the processing operations indicated below.

At this time the processing was carried out under two sets of conditions with the pH of the development processing liquid being set to (a) 10.30 and (b) 10.00. The samples (a) and (b) obtained by such processing were evaluated respectively in the same way as in Example 1.

The results obtained showed that, as in Examples 1 to 3, the change in photographic speed due to a change in the pH of the processing liquid was small when a yellow coupler of the present invention was used.

| Processing Operation | Temperature | Time | Tank Capacity |
|---|---|---|---|
| Color development | 40° C. | 15 sec. | 2 liters |
| Bleach-fix | 40° C. | 15 sec. | 2 liters |
| Rinse (1) | 40° C. | 3 sec. | 1 liter |
| Rinse (2) | 40° C. | 3 sec. | 1 liter |
| Rinse (3) | 40° C. | 3 sec. | 1 liter |
| Rinse (4) | 40° C. | 3 sec. | 1 liter |
| Rinse (5) | 40° C. | 6 sec. | 1 liter |
| Drying | 70–80° C. | 15 sec. | |

The water in Rinse (5) was fed under pressure to a reverse osmosis membrane and the permeating water was supplied to Rinse (5) while the concentrated water which had not passed through the reverse osmosis membrane was used by being returned to Rinse (4). Moreover, blades were established between the tanks and the material was passed between these blades in order to shorten the cross-over times between the rinse processes.

The composition of each processing bath was as indicated below.

| | Tank Liquid |
|---|---|
| Color Developer | |
| Water | 800 ml |
| Ethylenediamine tetra-acetic acid | 1.5 grams |
| Triisopropylnaphthalene(β)sulfonic acid, sodium salt | 0.01 gram |
| 1,2-Dihydroxybenzene-4,6-disulfonic acid, di-sodium salt | 0.25 gram |
| Potassium bromide | 0.03 gram |
| Triethanolamine | 5.8 grams |
| Potassium chloride | 10.0 grams |
| Potassium carbonate | 30.0 grams |
| Sodium bicarbonate | 5.3 grams |
| Sodium sulfite | 0.14 gram |
| 4-Amino-3-methyl-N-ethyl-N-(4-hydroxybutyl)aniline.2.p-toluenesulfonic acid | 14.5 grams |
| disodium-N,N-bis(sulfonatoethyl)-hydroxylamine | 7.4 grams |
| Fluorescent whitener (UVITEX CK, made by the Ciba Geigy Co.)) | 2.5 gram |
| Water | to make up to 1000 ml |
| pH (25° C.) | (a) 10.30, (b) 10.00 |
| Bleach-Fixer | |
| Water | 400 ml |
| Ammonium thiosulfate (700 g/l) | 100 ml |
| Sodium sulfite | 17 grams |
| Ethylenediamine tetra-acetic acid, iron(III) ammonium salt | 55 grams |
| Ethylene diamine tetra-acetic acid, di-sodium salt | 5 grams |
| Ammonium bromide | 40 grams |
| Water | to make up to 1000 ml |
| pH (25° C.) | 6.0 |

Rinse Bath (Tank liquid=Replenisher)

Ion exchanged water (Calcium and magnesium both below 3 ppm)

By using a yellow coupler of formula (I) in accordance with the present invention it is possible to obtain high picture quality images rapidly with little variation in photographic speed due to fluctuations in the development processing baths even when using short exposures at a high level of brightness with a scanning exposure system in which the exposure time per picture element is not more than $10^{-4}$ seconds.

While the invention has been described in detail and with reference to specific embodiments thereof, it will be apparent to one skilled in the art that various changes and modifications can be made therein without departing from the spirit and scope thereof.

What is claimed is:

1. A method of forming a colored image using a silver halide color photographic photosensitive material comprising a support, having thereon at least three silver halide photosensitive layers which have different color sensitivities and which contain amounts of yellow, magenta, and cyan color forming couplers effective to form visible yellow, magenta, and cyan dye images, respectively, wherein an amount of at least one yellow dye forming coupler effective to form a visible yellow dye image and represented by formula (I) is included in at least one yellow color forming coupler containing photosensitive layer of the silver halide color photosensitive material, and the photosensitive material is exposed using a laser scanning exposure system in which the exposure time per picture element is less than $10^{-4}$ seconds and subsequently subjected to color development processing:

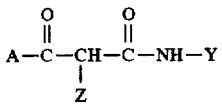

(I)

wherein A represents

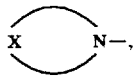

X represents an organic group which is required, together with the nitrogen atom, to form a nitrogen containing heterocyclic ring, Y represents an aromatic group or a heterocyclic group, and Z represents a group which is eliminated when a coupler which is represented by formula (I) reacts with an oxidation production of a developing agent.

2. The method of claim 1 wherein silver halide grains having a silver chloride content of at least 95 mol % are included in at least one yellow color forming coupler containing photosensitive layer.

3. The method of claim 1 wherein the spectral sensitivity peak of the silver halide photosensitive layer which contains the yellow dye forming coupler represented by formula (I) is above 430 nm and lasers are used for the scanning exposure light sources.

4. The method of claim 1 wherein the spectral sensitivity peaks of the three silver halide photosensitive layers which have different color sensitivities are all above 560 nm and semiconductor lasers are used for the scanning exposure light sources.

5. The method of claim 1 wherein the exposure is made with a scanning exposure system in which the exposure time per picture element is less than $10^{-7}$ seconds.

6. The method of claims 1 wherein the color development processing time is not more than 25 seconds and the total processing time from the color development process to the completion of drying is not more than 120 seconds.

7. The method of claim 2 wherein the spectral sensitivity peak of the silver halide photosensitive layer which contains the yellow dye forming coupler represented by formula (I) is above 430 nm and lasers are used for the scanning exposure light sources.

8. The method of claim 2 wherein the spectral sensitivity peaks of the three silver halide photosensitive layers which have different color sensitivities are all above 560 nm and semiconductor lasers are used for the scanning exposure light sources.

9. The method of claim 2 wherein the exposure is made with a scanning exposure system in which the exposure time per picture element is less than $10^{-7}$ seconds.

10. The method of claim 3 wherein the exposure is made with a scanning exposure system in which the exposure time per picture element is less than $10^{-7}$ seconds.

11. The method of claim 4 wherein the exposure is made with a scanning exposure system in which the exposure time per picture element is less than $10^{-7}$ seconds.

12. The method of claim 2 wherein the color development processing time is not more than 25 seconds and the total processing time from the color development process to the completion of drying is not more than 120 seconds.

13. The method of claim 3 wherein the color development processing time is not more than 25 seconds and the total processing time from the color development process to the completion of drying is not more than 120 seconds.

14. The method of claim 4 wherein the color development processing time is not more than 25 seconds and the total processing time from the color development process to the completion of drying is not more than 120 seconds.

15. The method of claim 5 wherein the color development processing time is not more than 25 seconds and the total processing time from the color development process to the completion of drying is not more than 120 seconds.

16. The method of claim 1 wherein at least one yellow dye forming coupler is represented by formula (II):

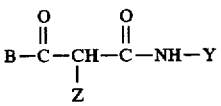

(II)

Wherein:

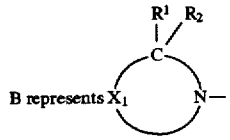

Y represents an aromatic group or a heterocyclic group, Z represents a group which is elimiatged when a coupler which is represented by formula (II) reacts with an oxidation product of a developing agent, $X_1$ represents an organic group which is required to form, together with —C($R_1R_2$)—N—, a nitrogen containing heterocyclic group, and $R_1$ and $R_2$ each represented a hydrogen atom or a substituent group.

17. The method of claim 1 wherein at least one yellow dye forming coupler is represented by formula (III):

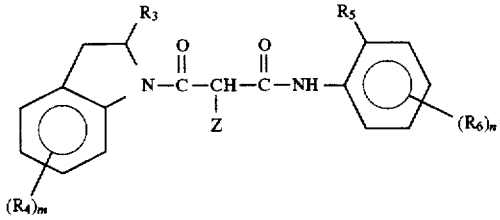

(III)

wherein $R_3$ represents a hydrogen atom or a substituent group, $R_4$, $R_5$ and $R_6$ each represents a substituent group, Z represents a group which is eliminated when a coupler which is represented by formula (III) reacts with an oxidation product of a developing agent, m and n each represents an integer of from 0 to 4 and when m and n are integers of 2 or more, the $R_4$ and $R_6$ groups may be the same or different, and they may be joined together to form rings.

18. The method of claim 17 wherein $R_3$ represents a hydrogen atom, an alkyl group or an aryl group, $R_4$ represents a halogen atom, an alkoxy group, an arylamino group, a carbamoyl group, an alkyl group, a sulfonamido group or a nitro group, $R_5$ represents a halogen atom, an alkoxy group, an alkyl group or an aryloxy group, and $R_6$ represents a halogen atom, an alkoxycarbonyl group, a sulfamoyl group, a carbamoyl group, a sulfonyl group, a sulfonamido group, an acylamino group, an alkoxy group, an aryloxy group, an N-acylcarbamoyl group, an N-sulfonylcarbamoyl group, an N-sulfamoylcarbamoyl group, an N-sulfonylsulfamoyl group, an N-acylsulfamoyl group, an N-carbamoylsulfamoyl group or an N-(N-sulfonylcarbamoyl) sulfamoyl group.

19. The method of claim 1, wherein the yellow dye forming coupler of formula (I) is present in an amount of $1\times10^{-3}$ mol to 1 mol per mol of silver halide in the layer containing the coupler of formula (I).

20. The method of claim 1 wherein the yellow color forming coupler containing photosensitive layer comprises a silver halide emulsion which has a silver chloride content of at least 95 mol % and which contains a plurality of ions or complexes of the metals belonging to Group VIII or IIb of the periodic table.

21. The method of claim 1, wherein the yellow color forming coupler is represented by formula (III):

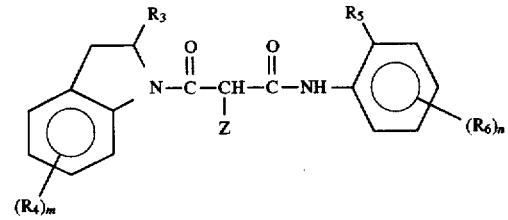

(III)

wherein $R_3$ represents a hydrogen atom or a substituent group, $R_4$ represents a substituent group, $R_5$ represents an alkoxy group, an alkyl group, or an aryloxy group, $R_6$ represents a substituent group, Z represents oxazolidin-2,4-dione-3-yl, 1,2,4-triazolidin-3,5-dione-4-yl, or imidazolidin-2,4-dione-3-yl, and m and n each represents an integer of from 0 to 4.

22. The method of claim 1 wherein the scanning exposure system is a high intensity scanning exposure system.

* * * * *